US008044934B2

(12) United States Patent
Arai et al.

(10) Patent No.: US 8,044,934 B2
(45) Date of Patent: Oct. 25, 2011

(54) OPERATING DEVICE, IMAGE DISPLAY SYSTEM, MAP DISPLAY CONTROLLER AND PROGRAM FOR MAP DISPLAY CONTROLLER

(75) Inventors: Rieko Arai, Nagoya (JP); Toshifumi Mori, Kariya (JP); Yoshiteru Takemori, Okazaki (JP); Teruaki Yamaguchi, Anjo (JP); Takuji Harada, Hekinan (JP); Yoshikatsu Ichikawa, Hazu-gun (JP); Ryouta Sugiura, Takahama (JP); Ryosuke Murata, Kariya (JP)

(73) Assignee: DENSO CORPORATION, Kariya (JP)

( * ) Notice: Subject to any disclaimer, the term of this patent is extended or adjusted under 35 U.S.C. 154(b) by 1251 days.

(21) Appl. No.: 11/723,778

(22) Filed: Mar. 22, 2007

(65) Prior Publication Data

US 2007/0233289 A1 Oct. 4, 2007

(30) Foreign Application Priority Data

Mar. 29, 2006 (JP) ..... 2006-092366

(51) Int. Cl.
*G09G 5/08* (2006.01)

(52) U.S. Cl. ..... 345/161; 463/38; 74/471 XY

(58) Field of Classification Search ..... 345/156, 345/161; 463/38; 74/741 XY
See application file for complete search history.

(56) References Cited

U.S. PATENT DOCUMENTS

| | | | | |
|---|---|---|---|---|
| 5,675,309 | A * | 10/1997 | DeVolpi | 338/68 |
| 6,330,837 | B1 * | 12/2001 | Charles et al. | 74/490.06 |
| 6,489,946 | B1 * | 12/2002 | Takeda et al. | 345/161 |
| 6,865,342 | B2 | 3/2005 | Hirata et al. | |
| 7,265,304 | B2 * | 9/2007 | Ichiki et al. | 200/6 A |
| 7,280,098 | B2 * | 10/2007 | Komelson | 345/161 |
| 2002/0080116 | A1 * | 6/2002 | Onodera et al. | 345/161 |
| 2005/0190153 | A1 * | 9/2005 | Ushimaru et al. | 345/161 |
| 2006/0124438 | A1 * | 6/2006 | Bader et al. | 200/6 A |
| 2007/0262959 | A1 * | 11/2007 | Gu | 345/161 |
| 2008/0184836 | A1 * | 8/2008 | Riwan | 74/471 XY |

FOREIGN PATENT DOCUMENTS

| | | |
|---|---|---|
| JP | A-58-172739 | 10/1983 |
| JP | U-01-138137 | 9/1989 |
| JP | U-H06-6806 | 1/1994 |
| JP | A-2000-226198 | 8/2000 |
| JP | A-2002-267481 | 9/2002 |

OTHER PUBLICATIONS

Notice of Reasons for Rejection mailed on Sep. 28, 2010 issued from the Japanese Patent Office in the corresponding Japanese patent application No. 2006-092366 (with English translation).

* cited by examiner

*Primary Examiner* — Amare Mengistu
*Assistant Examiner* — Premal Patel
(74) *Attorney, Agent, or Firm* — Posz Law Group, PLC

(57) ABSTRACT

An image display system has an operating device, a specifying device and an image display device. If the operating device receives a single operation from an exterior (i.e., from user), the operating device outputs first and second signals based on the single operation. The specifying device specifies a viewpoint and a sight line direction to look down a picture based on the first and second signals outputted by the operating device. The image display device displays an image of the picture in such a manner that the picture is looked down from the viewpoint in the sight line direction specified by the specifying device. As a result, the operation for adjusting the viewpoint and the sight line direction is facilitated.

15 Claims, 14 Drawing Sheets

OPERATING DEVICE, IMAGE DISPLAY SYSTEM, MAP DISPLAY CONTROLLER AND PROGRAM FOR MAP DISPLAY CONTROLLER

CROSS REFERENCE TO RELATED APPLICATION

This application is based on and incorporates herein by reference Japanese Patent Application No. 2006-92366 filed on Mar. 29, 2006.

BACKGROUND OF THE INVENTION

1. Field of the Invention

The present invention relates to an operating device, an image display system, a map display controller, and a program for the map display controller.

2. Description of Related Art

A user of an operating device described in JP-A-2003-99139 can perform two or more inputs with the single operating device by gripping and tilting a grip main body and by tilting a small lever provided on an upper portion of the grip main body with the thumb. However, this operating device can perform only a single kind of input through the single operation performed by the user with the hand gripping the grip of the operating device. The second kind of input is realized by additional motion of the thumb.

Conventionally, a device for sensing an inclination of the grip of the operating device has been provided near a supporting point supporting the grip. Accordingly, it has been difficult to make the grip thinner. Conventionally, the size of the operating device has to be enlarged to provide the center of the inclination of the grip of the operating device at a distant position.

A map display device described in JP-A-2002-267481 can set height of a viewpoint to view a map, a looking-down angle from the viewpoint, a spreading angle from the viewpoint and the like when the map display device displays a bird's-eye view of the map. However, the map display device requires complicated operations to set the height of the viewpoint, the looking-down angle and the like.

SUMMARY OF THE INVENTION

It is an object of the present invention to provide a technology enabling multiple inputs through a single operation performed with a hand of a user gripping an operating device. It is another object of the present invention to provide an operating device capable of sensing inclination of a grip at a point distant from a supporting point. It is another object of the present invention to provide an operating device capable of locating a center of inclination of a grip at a distant point while inhibiting increase in the size of the operating device. It is another object of the present invention to provide a technology capable of facilitating adjustment of a viewpoint and a direction of a sight line when a map is displayed. It is yet another object of the present invention to provide a technology capable of displaying a map with a wider variety than conventional technologies.

According to an aspect of the present invention, an operating device has a grip, a first supporting section that has a first end and a second end and that supports the grip with the first end, and a second supporting section for supporting the second end of the first supporting section. The grip can tilt about the first end of the first supporting section such that the first end acts as a supporting point. The first supporting section can tilt about the second end such that the second end acts as a supporting point.

If a user grips the grip and applies a force to the operating device, the force is transmitted to the grip and to the first supporting section through the first end from the grip. Due to the force, the grip can tilt with respect to the first supporting section about the first end functioning as the supporting point. The first supporting section can tilt with respect to the second supporting section about the second end functioning as the supporting point. The user can independently adjust moment around the first end and moment around the second end applied through the grip by applying a force to push the grip and a force to twist the grip with the hand gripping the grip. Accordingly, the user can respectively and simultaneously adjust a first inclination of the grip with respect to the first supporting section and a second inclination of the first supporting section with respect to the second supporting section by only gripping the grip and by applying the force to the grip through the hand gripping the grip. Accordingly, multiple inputs can be performed by the single operation performed through the hand of the user gripping the grip. Any surface of the object can be the end.

According to another aspect of the present invention, an operating device has a grip and a supporting section that has an end supporting the grip. The grip can tilt about the end of the supporting section such that the end acts as a supporting point. The supporting section includes multiple rods contacting different positions on the grip and a deviation sensing section for sensing a positional deviation among the rods caused by a change in the inclination of the grip with respect to the supporting section. The deviation sensing section can be located at a position distant from the end of the supporting section. Thus, the size of the grip can be reduced.

According to another aspect of the present invention, an operating device has a grip and a supporting section for supporting an end of the grip. The grip can tilt about the end thereof functioning as a supporting point. The supporting section has a rotating member that contacts and supports the end of the grip. The end of the grip is formed with a curved face providing a concave shape facing the rotating member. The end of the grip is supported by the rotating member at a part of the curved face. The curved face has a curvature radius longer than a radius of the rotating member.

Since the curvature radius of the curved face of the end of the grip contacting the rotating member is large, the central point of the inclination of the grip can be set quite distant from the end of the grip regardless of the size of the rotating member. Accordingly, a change amount of the inclination of the grip with respect to the supporting section can be decreased compared to the operation amount of the grip. As a result, the size of the operating device below the end of the grip can be reduced while reducing sensitivity with respect to the operation amount of the inclination.

According to another aspect of the present invention, an image display system has an operating device that outputs first and second signals based on a single operation applied from an exterior when the operating device receives the single operation from the exterior, a specifying device that specifies a viewpoint and a sight line direction to look down a picture based on the first and second signals outputted by the operating device, and an image display device that displays an image of the picture in such a manner that the picture is looked down from the viewpoint in the sight line direction specified by the specifying device. Thus, when the image of the picture is displayed in such the manner that the picture is looked down from a certain viewpoint in a certain sight line direction, the viewpoint and the sight line direction can be decided based on the single operation applied from the exterior, i.e., operation applied by a user. Accordingly, convenience of the operation performed by the user for adjusting the viewpoint and the sight line direction is improved.

According to yet another aspect of the present invention, a map display controller has a specifying device that specifies a direction to look down a map from above, wherein the direction is different from a forward direction, and a drawing control device that makes an image display device display the map in such a manner that the map is looked down in the looking-down direction specified by the specifying device. Thus, the map looked down in the direction different from the forward direction can be displayed. As a result, the map display can be performed with more variety than before, improving the visibility of the map for the user.

BRIEF DESCRIPTION OF THE DRAWINGS

Features and advantages of embodiments will be appreciated, as well as methods of operation and the function of the related parts, from a study of the following detailed description, the appended claims, and the drawings, all of which form a part of this application. In the drawings:

DETAILED DESCRIPTION OF EXAMPLE EMBODIMENTS

Figure 1:
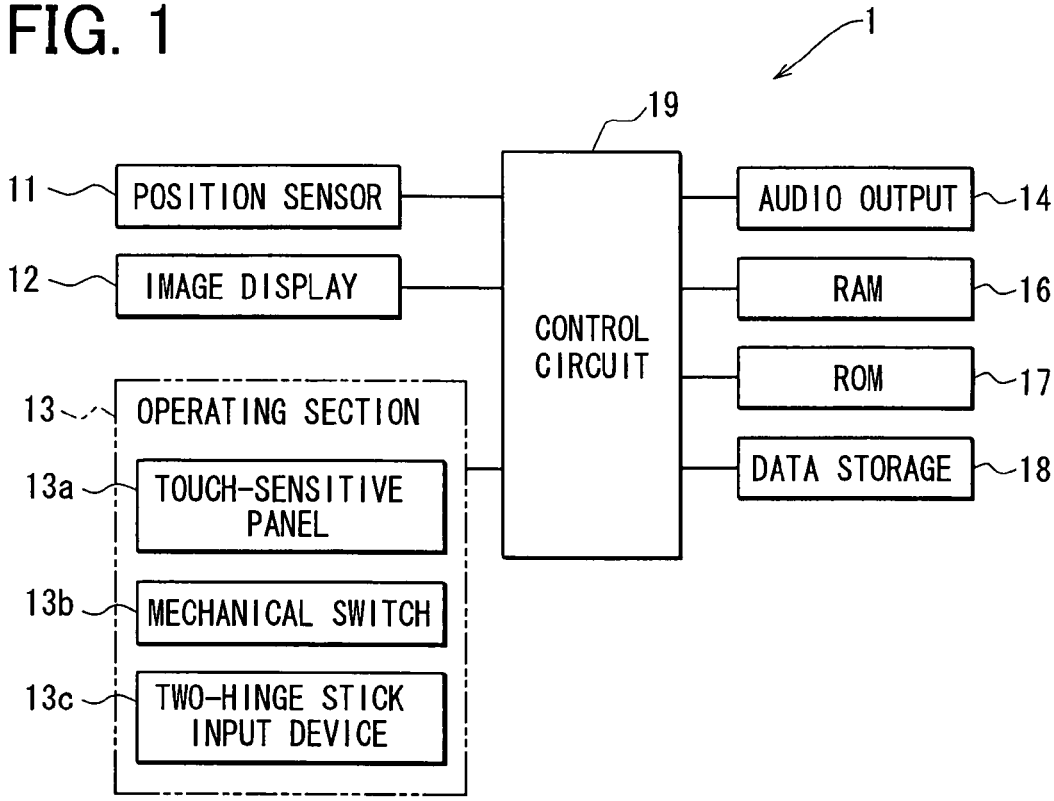
FIG. 1 is a hardware structure diagram showing a vehicle navigation system according to a first embodiment of the present invention.

Referring to FIG. 1, a hardware structure of a vehicle navigation system 1 according to a first example embodiment of the present invention is illustrated. The vehicle navigation system 1 has a position sensor 11, an image display device 12, an operating section 13, an audio output device 14, a RAM 16, a ROM 17, a data storage section 18 and a control circuit 19. The position sensor 11 has sensors (not shown) such as an earth magnetism sensor, a gyroscope, a vehicle speed sensor and a GPS signal receiver. The position sensor 11 outputs information for specifying a present position and a bearing of the vehicle based on various properties of the sensors to the control circuit 19. The image display device 12 displays an image to a user based on an image signal outputted from the control circuit 19. For example, the displayed image is a map centering on the present position. The audio output device 14 outputs an audio signal as a sound based on audio data transmitted from the control circuit 19.

The operating section 13 has devices for receiving operations from the user and for outputting signals based on the operations to the control circuit 19 such as a touch-sensitive panel 13*a* overlapped on a display screen of the image display device 12, a mechanical switch 13*b* attached to a periphery of the display screen or the like and a two-hinge stick input device 13*c*.

The data storage section 18 has non-volatile storage media such as a DVD, a CD and a HDD and a device for reading data from the storage media (and for writing data into storage media, if necessary). The data storage section 18 stores programs to be executed by the control circuit 19, map data for route guidance and the like. The map data contain information about geographic two-dimensional positions (e.g., longitude and altitude) on the ground regarding links representing roads, nodes representing intersections, facilities and the like. The map data further contain information indicating connection relationships among the links and the nodes.

The control circuit 19 executes the program read from the ROM 17 and the data storage section 18 for operating the vehicle navigation system 1. When the control circuit 19 executes the program, the control circuit 19 reads information from the RAM 16, the ROM 17 and the data storage section 18 and writes information into the RAM 16 and the data storage section 18. The control circuit 19 reciprocates signals with the position sensor 11, the image display device 12, the operating device 13 and the audio output device 14.

The control circuit 19 executes the program to perform processing such as present position specifying processing, guiding route calculating processing, route guiding processing, and map display controlling processing. The present position specifying processing specifies the present position or bearing of the vehicle based on the signal from the position sensor 11. The guiding route calculating processing receives the input of the destination inputted by the user from the operating section 13 and calculates the optimum guiding route from the present position to the destination. The route guiding processing performs route guidance such as right turn direction or left turn direction through images and sounds along the guiding route. The map display controlling processing displays the map image as the result of applying various types of processing to the map data read from the data storage section 18 in response to the various situations of the vehicle and the operations applied to the operating section 13 by the user on the image display device 12.

Figure 2:
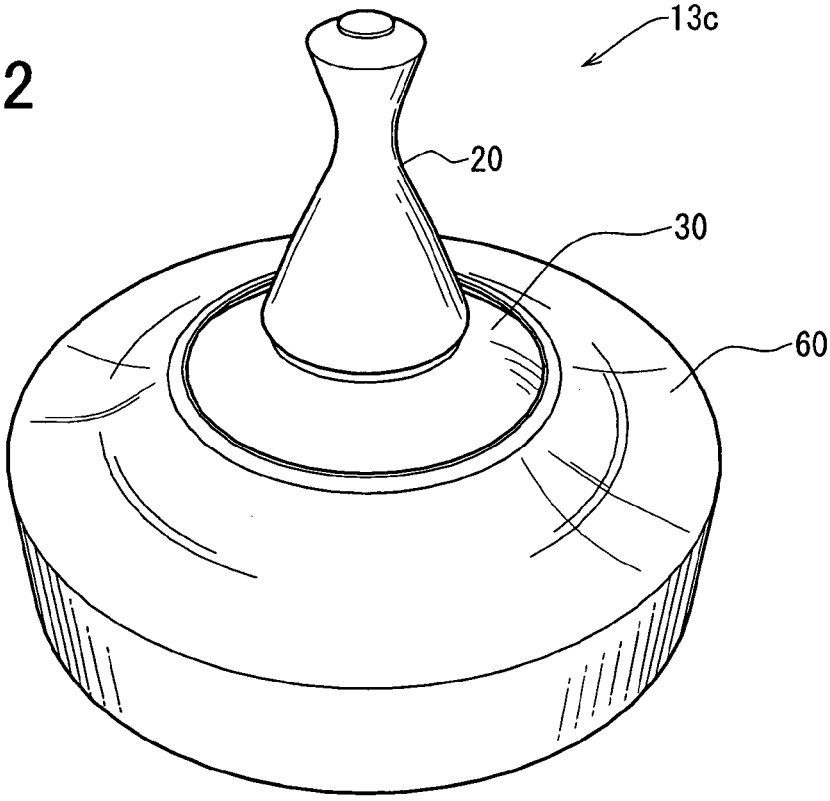
FIG. 2 is a perspective view showing a two-hinge stick input device according to the first embodiment.

Next, structure and operation of the two-hinge stick input device 13*c* according to the present embodiment will be explained. FIG. 2 is a perspective view showing an entire body of the two-hinge stick input device 13*c*. The two-hinge stick input device 13*c* has a grip 20 to be gripped by the user for the operation, a moving section 30 for supporting the grip 20 from beneath, and a base section 60 supporting the moving section 30 from beneath. The grip 20 can tilt with respect to the moving section 30 in all directions of 360°. The moving section 30 can tilt with respect to the base section 60 in all directions of 360°.

Figure 3:
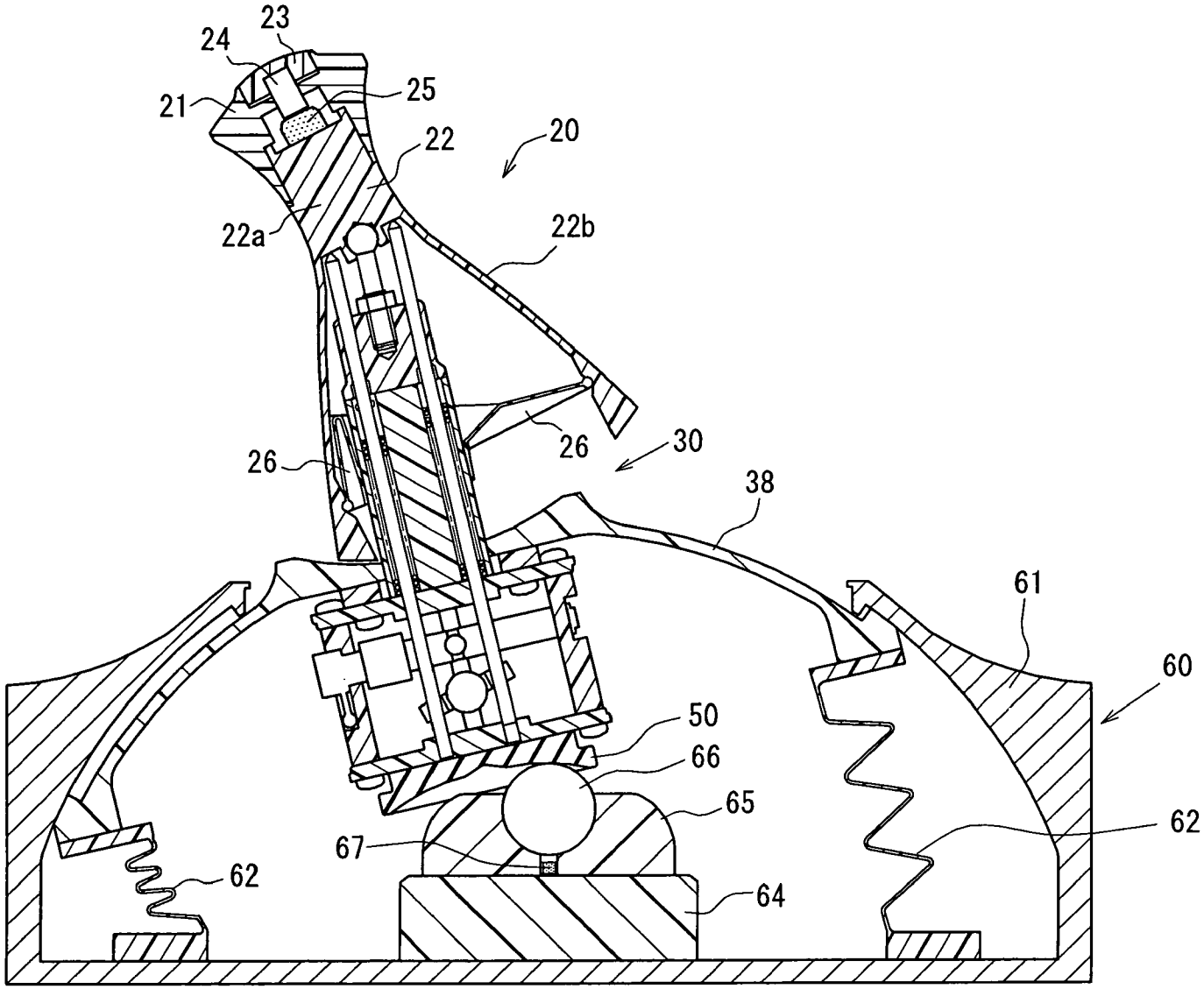
FIG. 3 is a vertical cross-sectional view showing the two-hinge stick input device according to the first embodiment.

FIG. 3 is a vertical sectional view showing the two-hinge stick input device 13*c* according to the present embodiment. The grip 20 has a dial 21, a grip main body 22, a button 23, a transmission section 24, a sensing circuit 25 and an elastic membrane 26.

The dial 21 is formed in the shape of a cylinder having thickness increasing from a lower portion toward an upper portion. The grip main body 22 is fitted into the lower end of the dial 21. The dial 21 rotates around the central axis of the cylindrical shape thereof. Thus, the dial 21 can slide with respective to the grip main body 22.

The button 23 is fitted into a cavity formed on the upper end portion of the dial 21. The transmission section 24 contacts the button 23 at the center of the bottom of the button 23. If the button 23 is depressed, the transmission section 24 descends with the button 23. If the depression of the button 23 ends, the transmission section 24 ascends with the button 23 because the transmission section 24 is pushed upward. The transmission section 24 is meshed with the dial 21 to rotate with the dial 21.

The sensing circuit 25 senses the rotation and the vertical motion of the transmission section 24 and outputs signals indicating the rotation and the vertical motion to the control circuit 19 through a signal line (not shown). Thus, the control circuit 19 can sense the rotation of the dial 21 and the depression of the button 23.

The grip main body 22 is formed in the shape of a circular conical face without a bottom such that an upper portion 22*a* (narrowed portion) of the circular conical face is thick and the upper end of the circular conical face is flat. The bottom face of the narrowed portion 22*a* contacts the upper end portion of the moving section 30. The grip 20 is supported by a force from the upper end portion of the moving section 30. The grip 20 can tilt with respect to the moving section 30 about a supporting point provided by the contacting point between the bottom face of the narrowed portion 22*a* and the upper end portion of the moving section 30.

A lower portion 22*b* (skirt portion) of the grip main body 22 is formed in the shape of a skirt that surrounds the upper portion of the moving section 30 and expands downward. An inner periphery of the skirt portion 22*b* near the bottom end thereof meshes with an outer edge portion of the elastic membrane 26. The elastic membrane 26 is made of an elastic member formed in the shape of a disc, a center of which is cut out.

Figure 4:
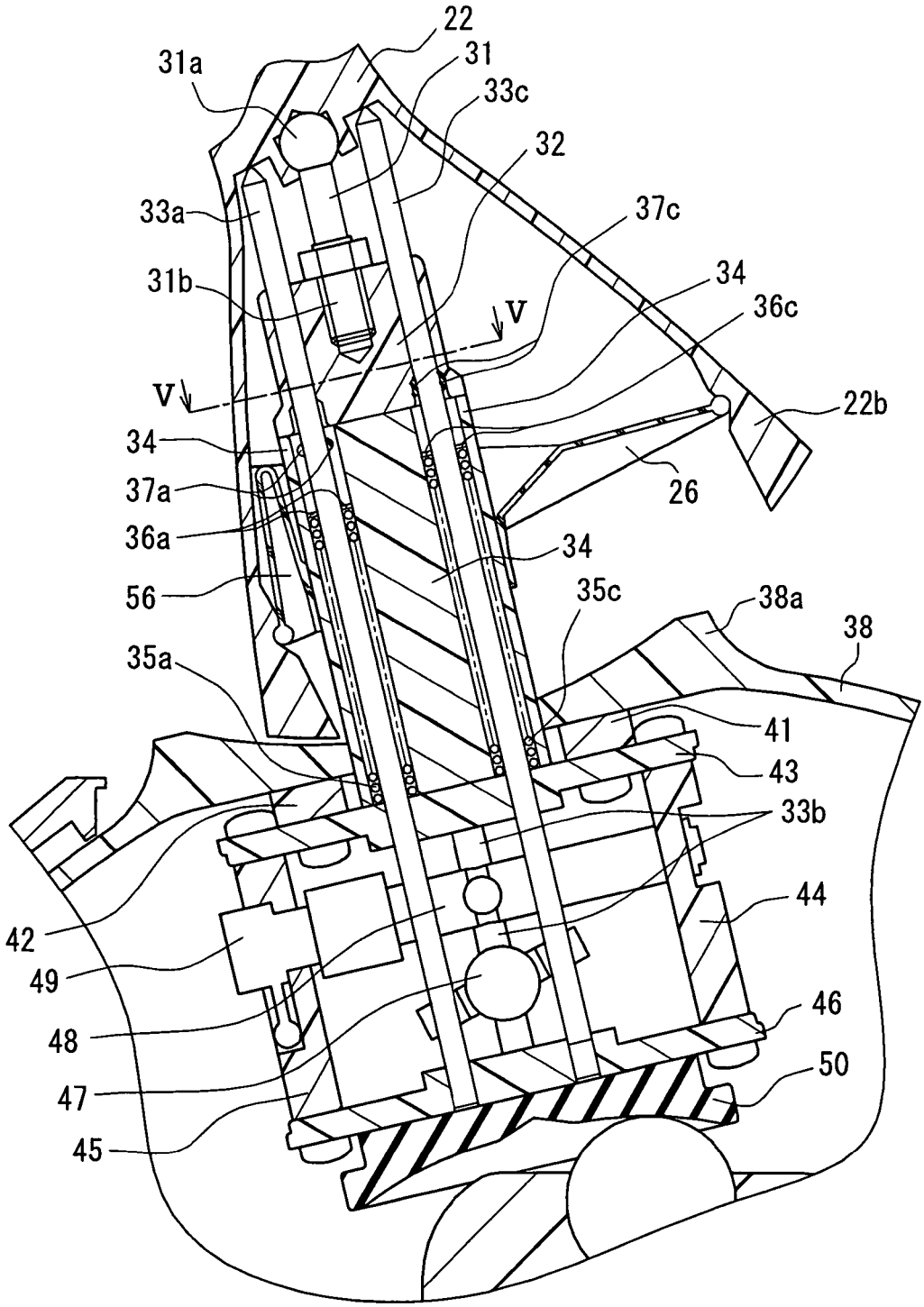
FIG. 4 is an enlarged cross-sectional view showing the two-hinge stick input device according to the first embodiment.

FIG. 4 shows proximity of the moving section 30 of FIG. 3 in an enlarged scale. The moving section 30 has a shaft 31, a first pillar penetration section 32, four pillars 33*a*-33*d*, a second pillar penetration section 34, four springs 35*a*-35*d*, four spring retainers 36*a*-36*d*, four pillar stoppers 37*a*-37*d*, a moving bottom face 38 (movable dome), mounting members 41-46, a first rotating section 47, a second rotating section 48, a first rotary encoder (not shown) and a second rotary encoder 49.

The shaft 31 is a member in the shape of a shaft provided immediately below the narrowed portion 22*a* for supporting the narrowed portion 22*a*. The shaft 31 has a supporting point section 31*a* and a shaft main body 31*b*. The supporting point section 31*a* is provided at the upper end portion of the shaft 31 and is fitted into a cavity formed in the bottom face of the narrowed portion 22*a*. The narrowed portion 22*a* can tilt about the supporting point section 31*a* acting as a supporting point in any direction by sliding on the supporting point section 31*a*. The shaft main body 31*b* extends downward from the supporting point section 31*a* and a part of the shaft main body 31*b* is screwed into the center of the upper end portion of the first pillar penetration section 32. Thus, the shaft 31 is fixed to the first pillar penetration section 32.

Figure 5:
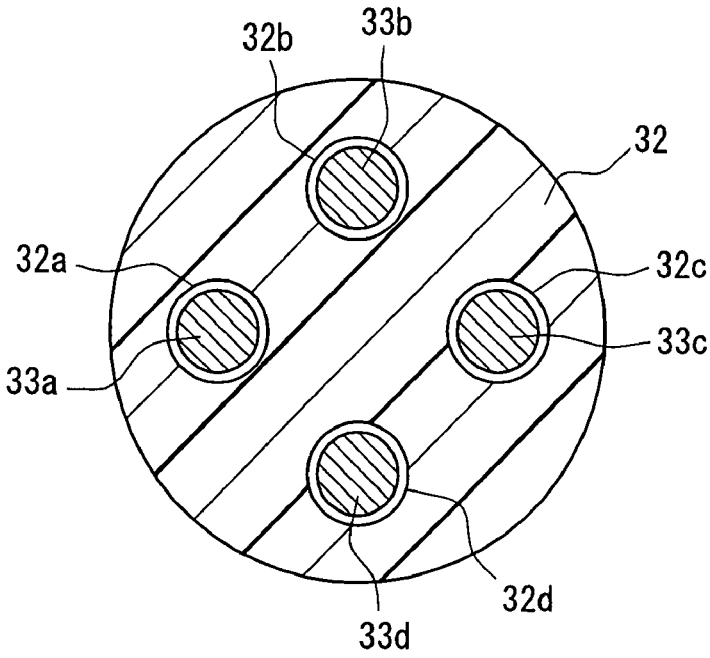
FIG. 5 is a cross-sectional view showing the two-hinge stick input device of FIG. 4 taken along the line V-V.

FIG. 5 is a V-V cross-sectional view of FIG. 4. As shown in FIG. 5, the first pillar penetration section 32 is formed with four hole forming portions 32*a*-32*d* at four corners equidistant from the center. The diameter of each one of the hole forming portions 32*a*-32*d* is substantially constant between the upper end and the proximity of the lower end of the first pillar penetration section 32 but slightly enlarges at the lowermost portion of the first pillar penetration section 32. The four pillars 33*a*-33*d* respectively penetrate through four holes provided by the hole forming sections 32*a*-32*d* such that the four pillars 33*a*-33*d* can move freely in the vertical direction. As exemplified by the pillars 33*a*, 33*c* in FIG. 4, a tapered upper end portion of each of the pillars 33*a*-33*d* strikes against one of four corners of the bottom face of the skirt portion 22*b*. The lower end of each one of the pillars 33*a*-33*d* extends to the proximity of the lower end of the moving section 30 in the shape of a bar through the second pillar penetration section 34, the mounting member 43, the first rotating section 47 and the second rotating section 48. The lower end portion of each one of the pillars 33*a*-33*d* is inserted into the mounting member 46 such that each of the pillars 33*a*-33*d* can move freely in the vertical direction.

As exemplified by the spring retainers 36*a*, 36*c* in FIG. 4, the flange-shaped spring retainers 36*a*-36*d* are fixed to outer peripheries of middle portions of the pillars 33*a*-33*d* respectively. As exemplified by the pillar stoppers 37*a*, 37*c* in FIG. 4, the flange-shaped elastic pillar stoppers 37*a*-37*d* are fixed to outer peripheries of the pillars 33*a*-33*d* above the spring retainers 36*a*-36*d*.

The second pillar penetration section 34 is mounted immediately under the first pillar penetration section 32. The second pillar penetration section 34 is formed with four penetration holes at positions overlapping with the positions of the hole forming sections 32*a*-32*d* of the first pillar penetration section 32. The pillars 33*a*-33*d* respectively penetrate through the penetration holes of the second pillar penetration section 34. The diameter of each penetration hole of the second pillar penetration section 34 is larger than that of each one of the hole forming sections 32*a*-32*d* of the first pillar penetration section 32. As exemplified by the springs 35*a*, 35*c* in FIG. 4, the springs 35*a*-35*d* are mounted in the four penetration holes respectively such that the springs 35*a*-35*d* surround the pillars 33*a*-33*d* respectively. The four springs 35*a*-35*d* are pressed by the spring retainers 36*a*-36*d* of the pillars 33*a*-33*d*, which are surrounded by the springs 35*a*-35*d*, from above. The lower ends of the springs 35*a*-35*d* are pressed against the upper face of the mounting member 43 fixed immediately below the second pillar penetration section 34.

An inner periphery of the elastic membrane 26 is fixed to an outer periphery of the second pillar penetration section 34 near a middle portion of the second pillar penetration section 34. The movable dome 38 in the shape of a circular dome is fixed to an outer periphery of the second penetration passage 34 near the lower end of the second pillar penetration section 34. The movable dome 38 is fixed to the second pillar penetration section 34 through the mounting member 43 fixed to the second pillar penetration section 34 and the mounting members 41, 42 fixing the lower face of the movable dome 38 with the mounting member 43. A circular protrusion 38*a* is formed on the movable dome 38 at a position, which overlaps with the end of the skirt portion 22*b* when the grip 20 is not inclined with respect to the moving section 30.

The mounting members 44, 45 are fixed to the mounting member 43 and extend downward. The mounting member 46 is fixed to the lower ends of the mounting members 44, 45. A spherical dish 50 as the lower end portion of the moving section 30 is fixed to the bottom of the mounting member 46 such that a concave curved face of the spherical dish 50 faces downward. The shape of the concave curved face of the spherical dish 50 substantially coincides with a part of a spherical surface. A curvature radius of the curved face is at least several times as long as the distance between the spherical dish 50 and the bottom of the two-hinge stick input device 13*c*. The spherical portion of the spherical dish 50 contacts and is supported by the upper end portion of the base section 60. Thus, the moving section 30 can tilt with respect to the base section 60 in the all directions of 360°.

Figure 6:
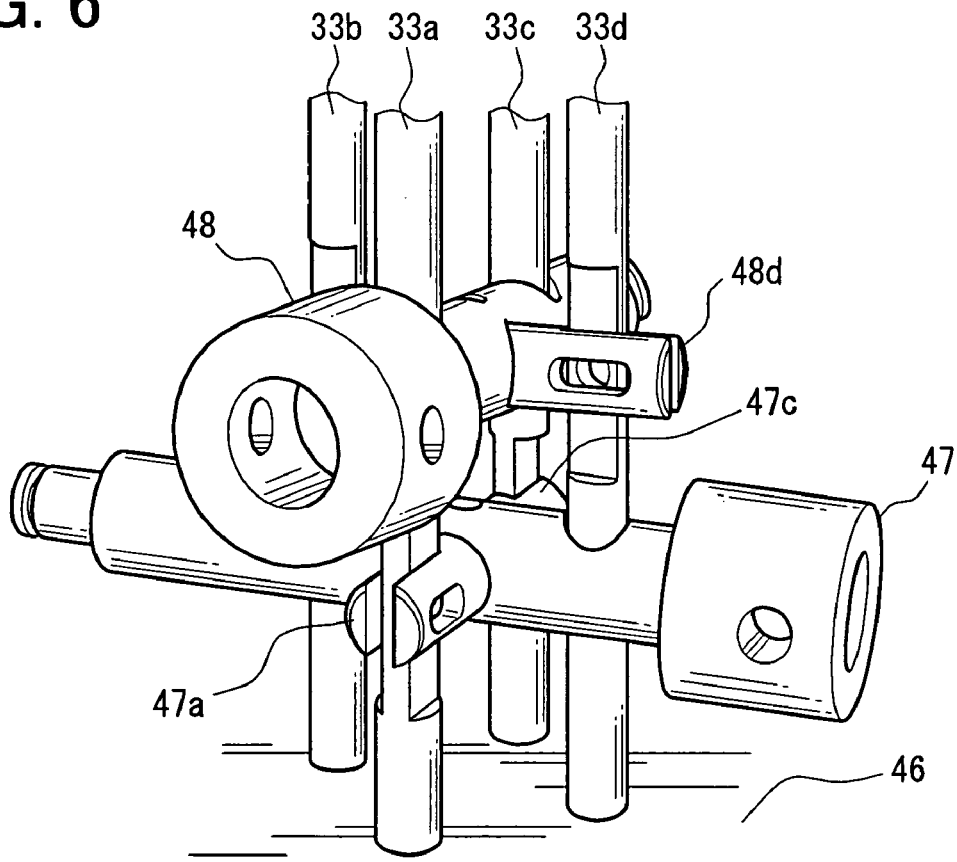
FIG. 6 is an enlarged perspective view showing a deviation sensing mechanism according to the first embodiment.

A mechanism (deviation sensing mechanism) for sensing vertical displacements of the pillars 33*a*-33*d* are fixed to the mounting members 44, 45 and the like between the mounting members 43, 44. FIG. 6 is an enlarged perspective view showing a part of the deviation sensing mechanism. The deviation sensing mechanism includes the first rotating section 47, the second rotating section 48, the first rotary encoder and the second rotary encoder 49.

The rod-like first rotating section 47 is a horizontal member in the shape of a rod for sensing a relative displacement in the vertical direction between the pillars 33*a*, 33*c*. A main body portion of the first rotating section 47 is formed with two holes, through which the pillars 33*b*, 33*d* penetrate in the vertical direction. The diameters of the holes are set such that the pillars 33*b*, 33*d* do not hinder the rotation of the first rotating section 47 when the first rotating section 47 rotates within a predetermined limit angle (for example, 15°) around its longitudinal axis. The first rotating section 47 has engagement sections 47*a*, 47*c* extending from its main body perpendicularly to the main body and substantially horizontally. The engagement sections 47*a*, 47*c* are formed with grooves respectively. The pillars 33*a*, 33*c* penetrate through the grooves respectively in the vertical direction. Horizontal holes are formed in the portions of the engagement sections 47*a*, 47*c* providing the grooves. Protrusions formed on the pillars 33*a*, 33*c* are fitted into the holes of the engagement sections 47*a*, 47*c*. The first rotary encoder is mounted to an enlarged-side end of the main body of the first rotating section 47. The first rotary encoder senses the rotation amount of the first rotating section 47 and outputs a signal indicative of the sensed rotation amount to the control circuit 19.

The rod-like second rotating section 48 provided above the first rotating section 47 is a horizontal member in the shape of a rod for sensing a relative displacement in the vertical direction between the pillars 33*b*, 33*d*. A main body portion of the second rotating section 48 is formed with two holes, through which the pillars 33*a*, 33*c* penetrate in the vertical direction. The diameters of the holes are set such that the pillars 33*a*, 33*c* do not hinder the rotation of the second rotating section 48 when the second rotating section 48 rotates within a predetermined limit angle around its longitudinal axis. The second rotating section 48 has two engagement sections (one is engagement section 48*d* and the other one 48*b* is not shown) extending from the main body perpendicularly to the main body and substantially horizontally. The engagement sections 48*b*, 48*d* are formed with grooves respectively. The pillars 33*b*, 33*d* penetrate through the grooves respectively in the vertical direction. Horizontal holes are formed in the portions of the engagement sections 48*b*, 48*d* providing the grooves. Protrusions formed on the pillars 33*b*, 33*d* are fitted into the holes of the engagement sections 48*b*, 48*d*. The second rotary encoder 49 is attached to an enlarged-side end of the main body of the second rotating section 48. The second rotary encoder 49 senses the rotation amount of the second rotating section 48 and outputs a signal indicative of the sensed rotation amount to the control circuit 19.

As shown in FIG. 3, the base section 60 has a casing 61, a cushion 62, a base 64, a ball receiving section 65, a ball 66, and a rotation sensing section 67. The casing 61 is fixed immediately next to a driver's seat in a vehicle cabin, for example. The casing 61 covers the bottom face and the lower portion of the side face of the moving section 30 and a part of the upper face of the movable dome 38. The cushion 62 is a bellows tube that is made of a resin having elasticity. The circumference of the lower end of the cushion 62 is fixed onto an inner face of a bottom plate of the casing 61. The circumference of the upper end of the cushion 62 is fixed to the circumference of the lower end of the movable dome 38.

The base 64 is fixed onto the central portion of the bottom plate of the casing 61. The ball receiving section 65 is fixed to the upper face of the base 64. A spherical ball 66 is fitted to a cavity formed in an upper end of the ball receiving section 65 such that the ball 66 can rotate. The rotation sensing section 67 senses the rotation amount and rotation direction of the ball 66 with a known mechanism and outputs signals indicative of the sensed rotation amount and the rotation direction to the control circuit 19. The ball 66 contacts a part of the curved face of the spherical dish 50 of the moving section 30. Thus, the ball 66 supports the moving section 30 such that the moving section 30 can tilt about the spherical dish 50 acting as a supporting point in the all directions of 360°.

Thus, the two-hinge stick input device 13*c* has the grip 20, which can be gripped by the user, the moving section 30 supporting the grip 20 at the supporting point section 31*a*, and the base section 60 supporting the spherical dish 50 of the moving section 30. The grip 20 can tilt about the supporting point section 31*a* acting as the supporting point. The moving section 30 can tilt about the spherical dish 50 acting as the supporting point.

If the user applies a force to the two-hinge stick input device 13*c* by gripping the grip 20, the force is transmitted to the grip 20 and to the moving section 30 through the supporting point section 31*a* and the like from the grip 20. Due to the force, the grip 20 can tilt with respect to the moving section 30 about the supporting point section 31*a* acting as the supporting point, and the moving section 30 can tilt with respect to the base section 60 about the spherical dish 50 acting as the supporting point.

Figure 7:
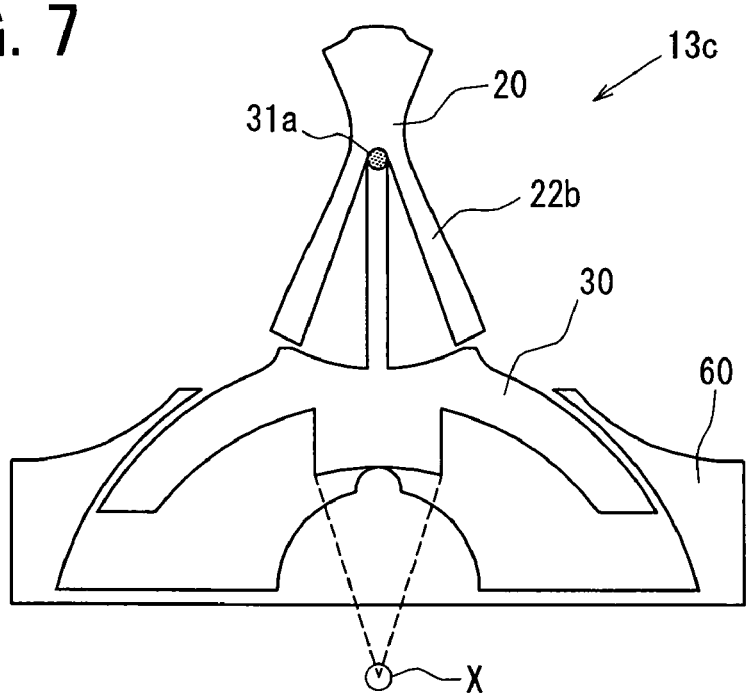
FIG. 7 is a schematic diagram showing the two-hinge stick input device in an initial state according to the first embodiment.

Locations of the grip 20, the moving section 30 and the base section 60 in an initial state in which the grip 20 and the moving section 30 are not inclined are schematically shown in FIG. 7. As shown in FIG. 7, in the initial state, the grip 20 faces downward in the vertical direction with reference to the skirt portion 22*b* and the moving section 30 faces upward in the vertical direction when the base section 60 is located horizontally. The inclination of the grip 20 with respect to the moving section 30 at that time is referred to as a first initial inclination, and the inclination of the moving section 30 with respect to the base section 60 at that time is referred to as a second initial inclination hereinafter. In a state in which the user is not touching the two-hinge stick input device 13*c*, the two-hinge stick input device 13*c* is in the initial state.

Thus, the first and second initial inclinations are not directed in the same direction. Rather, the first and second initial inclinations are deviated from each other by 90° or more and directed in the opposite directions. Accordingly, height of a space occupied by the portion of the two-hinge stick input device 13*c* above the supporting point section 31*a* can be reduced.

Next, an operation of the two-hinge stick input device 13*c* in the case where the two-hinge stick input device 13*c* changes from the initial state will be explained.

(A) Resistance Against the Inclination of the Grip 20 with Respect to the Moving Section 30:

If the inclination of the grip 20 with respect to the moving section 30 (first inclination) changes from the first initial inclination as shown in FIG. 3, resistance for returning the first inclination to the first initial inclination is generated due to deformation of the elastic membrane 26 and the springs 35*a*-35*d*. As shown in FIG. 3, if the grip 20 inclines with respect to the moving section 30, a certain part of the skirt portion 22*b* approaches to the upper portion of the moving section 30, so a part of the elastic membrane 26 close to the certain part of the skirt portion 22*b* is bent. Accordingly, a restoring force for undoing the bend is caused in the elastic membrane 26. The restoring force provides an elastic resistance in a direction for canceling the inclination of the grip 20 with respect to the moving section 30.

As shown in FIG. 4, if the grip 20 inclines with respect to the moving section 30 from the first initial inclination, one or two of the pillars 33*a*-33*d* (pillar 33*c* in FIG. 4) are pushed upward by corresponding one or two of the springs 35*a*-35*d* (spring 35*c* in FIG. 4) and move upward. Accordingly, one or two of the pillars 33*a*-33*d* (pillar 33*a* in FIG. 4) at the corner (s) opposite to the ascending one or two of the pillars 33*a*-33*d* are pushed by the bottom of the skirt portion 22*b* and descend while compressing corresponding one or two of the springs 35*a*-35*d* (spring 35*a*, in FIG. 4). At that time, the force applied to one or two of the pillars 33*a*-33*d* by the compressed one or two of the springs 35*a*-35*d* is greater than the force applied to another one or two of the pillars 33*a*-33*d* by one or two of the springs 35*a*-35*d* at the corner(s) opposite to the compressed one or two of the springs 35*a*-35*d*. The difference between the spring forces provides a resistance in a direction for canceling the inclination of the grip 20 with respect to the moving section 30. Because of such the restoring forces, the first inclination returns to the first initial inclination if the user releases the hand from the grip 20.

Thus, the moving section 30 has the multiple pillars 33*a*-33*d* contacting the different positions on the grip 20 and the elastic members applying the forces to the pillars 33*a*-33*d* in accordance with the relative positional changes of the pillars 33*a*-33*d* in the vertical direction to undo the positional changes.

(B) Sensing of the Inclination of the Grip 20 with Respect to the Moving Section 30:

As described above, if the vertical deviation is caused between the pillars 33*a*-33*d* provided at the opposite corners (pillars 33*a*, 33*c* in example shown in FIG. 4), either or both of the first rotating section 47 and the second rotating section 48 rotate due to the engagement between the protrusions of the pillars 33*a*-33*d* and the engagement sections 47*a*, 47*c*, 48*b*, 48*d* of the first and second rotating sections 47, 48. The first rotary encoder and the second rotary encoder 49 sense the rotations of the first and second rotating sections 47, 48 respectively and output the sensed rotations to the control circuit 19.

Thus, the moving section 30 has the multiple pillars 33*a*-33*d* contacting the different positions on the grip 20 and the deviation sensing mechanism (i.e., first rotating section 47, second rotating section 48, first rotary encoder and second rotary encoder 49) for sensing the positional deviation among the multiple pillars 33*a*-33*d* caused by the change in the inclination of the grip 20 with respect to the moving section 30. Thus, the deviation sensing mechanism can be provided at a position distant from the supporting point section 31*a*. As a result, the grip 20 can be made thin.

(C) Resistance Against the Inclination of the Moving Section 30 with Respect to the Base Section 60:

If the inclination of the moving section 30 with respect to the base section 60 (second inclination) changes from the second initial inclination as shown in FIG. 3, a resistance for returning the second inclination to the second initial inclination is caused due to the deformation of the cushion 62. As shown in FIG. 3, if the moving section 30 tilts with respect to the base section 60, a part of the edge of the movable dome 38 approaches to the bottom plate of the casing 61 and a certain part of the cushion 62 closest to the approaching part of the edge of the movable dome 38 and proximity of the certain part of the cushion 62 contract. Another part of the cushion 62 most distant from the certain part and the proximity of the most distant part expand. Accordingly, a restoring force for undoing the contraction and expansion is caused in the cushion 62. The restoring force provides an elastic resistance in a direction for undoing the inclination of the moving section 30 with respect to the base section 60. The grip 20 also has a function of stabilizing the position of the movable dome 38.

(D) Sensing of the Inclination of the Moving Section 30 with Respect to the Base Section 60:

If the moving section 30 provides the inclination other than the second initial inclination as shown in FIG. 3, the part of the curved face of the bottom section of the spherical dish 50 contacting the ball 66 changes. Due to a frictional force caused between the curved face of the bottom section of the spherical dish 50 and the ball 66, the ball 66 rotates by an amount corresponding to the change of the contacting part in the direction of the change. The rotation sensing section 67 senses the direction and the amount of the rotation and outputs a signal indicative of the sensing results to the control circuit 19.

In the case where the position at which the spherical dish 50 is supported by the ball 66 changes in accordance with the change in the second inclination, the center of the inclination of the entire body of the moving section 30 is positioned at a distant position from the spherical dish 50 by the curvature radius of the curved face of the spherical dish 50. The center of the inclination is a point (or a space), through which an extended line in the direction of the inclination necessarily runs regardless of the inclination of the moving section 30. As described above, the curvature radius of the curved face of the spherical dish 50 is longer than the curvature radius of the ball 66 and is several time as long as the distance between the ball 66 and the bottom face of the base section 60. Therefore, the center of the inclination of the moving section 30 is not restricted by the size of the ball 66 or the length of the two-hinge stick input device 13*c*. The center of the inclination of the moving section 30 is at a position outside the two-hinge stick input device 13*c* as shown by X in FIG. 7. Compared to the case where the central point is close, the inclination of the moving section 30 with respect to the base section 60 does not change largely even if the position of the moving section 30 changes largely.

Thus, by increasing the size of the curved face of the end of the moving section 30 contacting the ball 66 as a rotating member, the central point of the inclination of the moving section 30 can be set at a position distant from the position of the spherical dish 50 regardless of the size of the ball 66 or the two-hinge stick input device 13*c*. Thus, the change amount of the inclination of the moving section 30 around the supporting point with respect to the displacement of the moving section 30 (corresponding to operation amount of grip 20 as described after) can be reduced. That is, the size of the operating device below the end of the moving section 30 can be reduced while reducing the sensitivity of the inclination with respect to the operation amount.

(E) Response of the Two-Hinge Stick Input Device 13*c* to the Operation of a User:

Next, operation by the user applied to the two-hinge stick input device 13*c* will be explained. The user grips the grip 20 and applies a force to the grip 20 through the hand (palm) gripping the grip 20. Thus, the user adjusts the first inclination and the second inclination. The respective restoring forces of the springs 35*a*-35*d*, the elastic membrane 26 and the cushion 62 are adjusted such that the change in the first inclination is much smaller than the change in the second inclination when the user pushes a point of the dial 21 or the grip main body 22 regardless of the position of the pushed point.

For example, the movement around the supporting point section 31*a* as the supporting point is hardened by increasing the restoring force(s) of the springs 35*a*-35*d* or the elastic membrane 26. Accordingly, the user can adjust only the second inclination by pushing or pulling the grip 20 naturally and straight with the hand gripping the grip 20 through the elbow and shoulder when the user wants to adjust only the second inclination. Thus, a twisting force necessary for mainly adjusting the second inclination is small, so the adjustment of the second inclination is facilitated.

The user can adjust only the first inclination by operating the grip 20 by putting power into the wrist and by twisting the grip 20 when the user wants to adjust only the first inclination. The user can adjust the first and second inclinations simultaneously by suitably combining the natural straight force and the twisting force when the user wants to adjust the first and second inclinations simultaneously.

Thus, the user can adjust the moment around the supporting point section 31*a* and the moment around the spherical dish 50 applied to the grip 20 simultaneously and independently by applying the force pushing the grip 20 and the force twisting the grip 20 through the hand gripping the grip 20. Accordingly, the user can adjust the inclination of the grip 20 with respect to the moving section 30 and the inclination of the moving section 30 with respect to the base section 60 respectively by only gripping the grip 20 and applying the force to the grip 20 through the hand gripping the grip 20. Accordingly, multiple inputs can be performed by a single-action operation through the hand (palm, for example) of the user gripping the two-hinge stick input device 13*c*. Thus, the twisting force necessary for mainly adjusting the second inclination is reduced, and the adjustment of the second inclination is facilitated.

If an angle between the first inclination and the first initial inclination of the grip 20 reaches a limit angle (for example, 15°), one of the pillar stoppers 37*a*-37*d* fixed to one of the pillars 33*a*-33*d* having moved to the highest position gets into one of the hole forming sections 32*a*-32*d* of the first pillar penetration section 32 smaller than the hole of the second pillar penetration section 34. Because of the resistance, the further movement of the grip 20 is strongly restricted.

If an angle between the second inclination and the second initial inclination of the moving section 30 reaches a limit angle (for example, 20°), the protrusion 38*a* strikes against the upper end of the casing 61. Due to the resistance, the further movement of the moving section 30 is strongly restricted.

Figure 8:
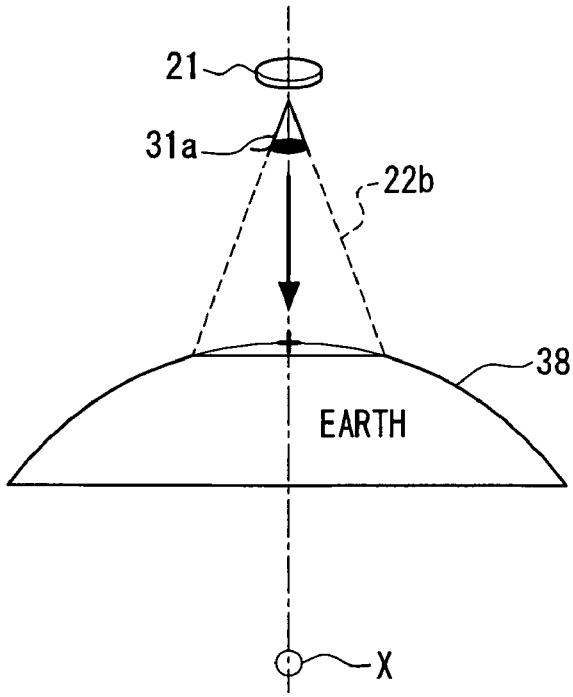
FIG. 8 is a diagram conceptually showing an assumption during an operation of the two-hinge stick input device according to the first embodiment.

(F) Interlock with the Map Display:

Next, interlocking operation between the operation applied to the two-hinge stick input device 13*c* and the map display controlling processing performed by the control circuit 19 will be explained. The user operates the two-hinge stick input device 13*c* by regarding the spherical movable dome 38 as the earth, the supporting point section 31*a* supporting the grip 20 as an eye of a person, the skirt portion 22*b* as a view angle of the eye, and the dial 21 as a lens as shown in FIG. 8. It is because the first inclination of the grip 20 with respect to the moving section 30 is reflected in the direction of the sight line of the bird's-eye map displayed by the image display device 12, the second inclination of the moving section 30 with respect to the base section 60 is reflected in the position of the viewpoint, and the rotation amount of the dial 21 is reflected in a display contraction scale of the displayed map.

Figure 9:
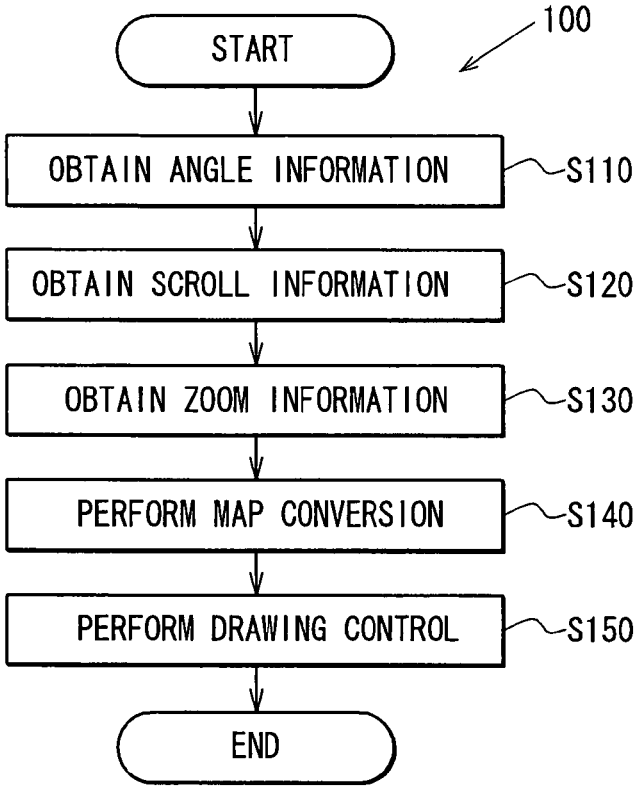
FIG. 9 is a flowchart showing a program executed by a control circuit according to the first embodiment.

The control circuit 19 repeatedly performs a program 100 shown in FIG. 9 to execute the map display controlling processing. The control circuit 19 obtains angle information at Step S110 in each execution of the program 100. Then, the control circuit 19 obtains scroll information at Step S120. Then, the control circuit 19 obtains zoom information at Step S130. The angle information indicates the angle (first relative inclination angle) and the bearing (first relative bearing) of the first inclination with respect to the first initial inclination. The control circuit 19 specifies the angle information based on the signals outputted from the first rotary encoder and the second rotary encoder 49 of the two-hinge stick input device 13*c*. The scroll information indicates the angle (second relative inclination angle) and the bearing (second relative bearing) of the second inclination with respect to the second initial inclination. The control circuit 19 specifies the scroll information based on the signals outputted from the rotation sensing section 67 of the two-hinge stick input device 13*c*. The zoom information indicates the rotation direction and the rotation amount of the dial 21. The control circuit 19 specifies the zoom information based on the signals outputted from the sensing circuit 25.

Then, Step S140 performs conversion process of the map data based on the obtained angle information, scroll information and zoom information. Then, Step S150 performs drawing control of drawing the image resulting from the conversion process. Thus, the image is displayed by the image display device 12.

Figure 10:
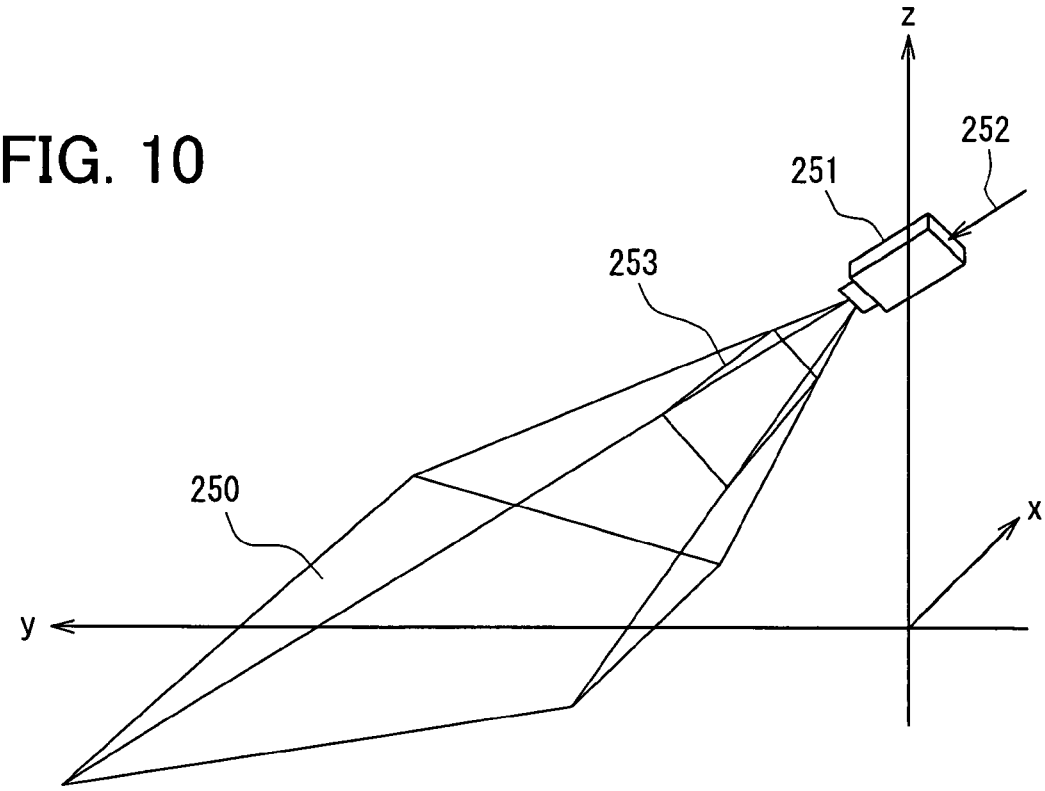
FIG. 10 is a diagram conceptually showing map conversion processing executed by the control circuit according to the first embodiment.

FIG. 10 shows the conversion process on a conceptual basis. The conversion process calculates an image of a map 250 photographed with a virtual midair camera 251. The map 250 depicts original geographic two-dimensional arrangement of the links, the nodes and the facilities described in the map data stored in the data storage section 18. The arrangement of the links, the nodes and the facilities in the photographed image 253 is decided uniquely if the position on the map right below the camera 251 (i.e., x-y coordinates of the camera 251 as shown in FIG. 10, referred to as two-dimension photographing position, hereinafter), a photographing direction 252 of the camera 251 and the zoom value of the camera 251 are decided.

The two-dimension photographing position is decided based on the scroll information. For example, a new two-dimension photographing position is calculated by applying the moving direction and the moving amount, which are decided based on the scroll information specified at present Step S120, to the two-dimension photographing position, which is specified at Step S140 when the program 100 is executed previously. The moving amount increases as the second relative inclination angle increases. The moving direction coincides with the second relative bearing. For example, the moving direction is the forward direction if the second relative bearing is in the forward direction when viewed from the user. The moving direction is the rightward direction if the second relative bearing is in the rightward direction when viewed from the user. The moving direction is the backward direction if the second relative bearing is directed toward the user.

The direction in the map 250 corresponding to the bearing of the vehicle specified by the position sensor 11 may be employed as the forward direction of the map 250. Alternatively, the forward direction may be specified based on specific operation of the user applied to the operating section 13.

The photographing direction 252 is decided based on the angle information. For example, the depression angle of the virtual camera 251 is calculated by subtracting the first relative inclination angle from 90°. The first relative bearing is used as the front to back and side to side direction of the virtual camera 251. For example, if the first relative bearing is the direction for moving the skirt portion 22*b* forward when viewed from the user, the virtual camera 251 faces forward. If the first relative bearing is the direction for moving the skirt portion 22*b* forward on the left when viewed from the user, the virtual camera 251 faces forward on the left. If the first relative bearing is the direction for moving the skirt portion 22*b* toward the user, the virtual camera 251 faces backward. The zoom value is decided based on the zoom information.

Figure 11:
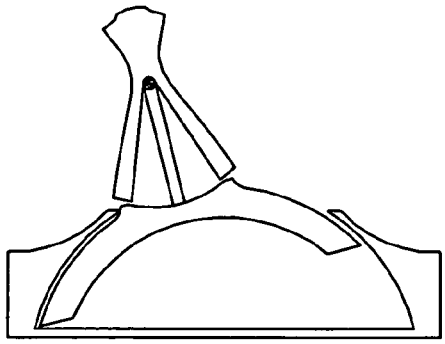
FIG. 11 is an operation example of the two-hinge stick input device according to the first embodiment.
Figure 12:
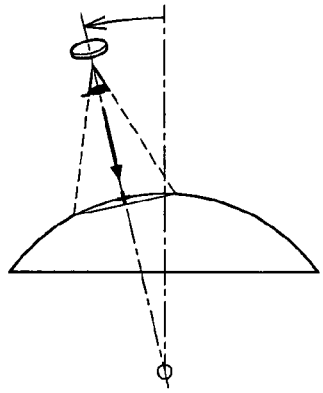
FIG. 12 is a diagram conceptually showing an operation intention of a user corresponding to the operation shown in FIG. 11.

FIG. 11 shows an example of increasing only the second inclination in the forward direction while holding the first inclination at the first initial inclination. The operation intention of the user in this case is to move the midair eye forward along the surface of the earth while directing the sight line downward in the vertical direction as shown in FIG. 12. At that time, the control circuit 19 repeatedly executes the program 100 such that the image display device 12 scrolls the map backward at scroll speed corresponding to the second relative inclination angle.

Figure 13:
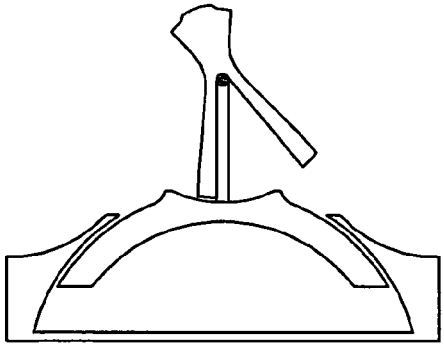
FIG. 13 is a diagram conceptually showing another operation example of the two-hinge stick input device according to the first embodiment.
Figure 14:
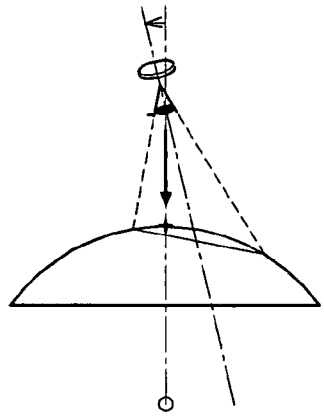
FIG. 14 is a diagram conceptually showing an operation intention of the user corresponding to the operation shown in FIG. 13.

FIG. 13 shows an example of directing only the first inclination toward the user while holding the second inclination at the second initial inclination. The operation intention of this example is to direct the sight line backward without changing the position of the midair eye as shown in FIG. 14. At that time, the control circuit 19 executes the program 100 such that the image display device 12 displays the backward bird's-eye map at the depression angle based on the first relative inclination angle.

Figure 15:
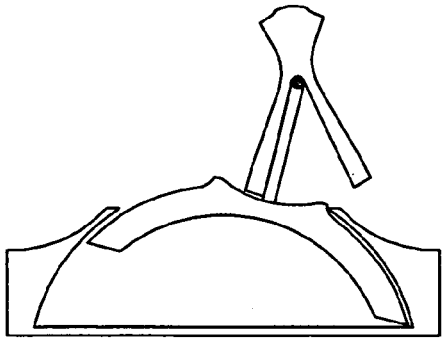
FIG. 15 is a diagram conceptually showing yet another operation example of the two-hinge stick input device according to the first embodiment.
Figure 16:
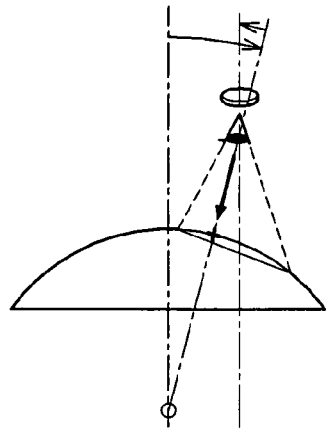
FIG. 16 is a diagram conceptually showing an operation intention of the user corresponding to the operation shown in FIG. 15.

FIG. 15 shows an example of tilting both of the first inclination and the second inclination toward the user. The operation intention of this example is to move the midair eye backward along the surface of the earth and to direct the sight line backward at the same time as shown in FIG. 16. At that time, the control circuit 19 repeatedly performs the program 100 such that the image display device 12 scrolls the backward bird's-eye map at the depression angle, which is based on the first relative inclination angle, forward at scroll speed corresponding to the second relative inclination angle.

Figure 17:
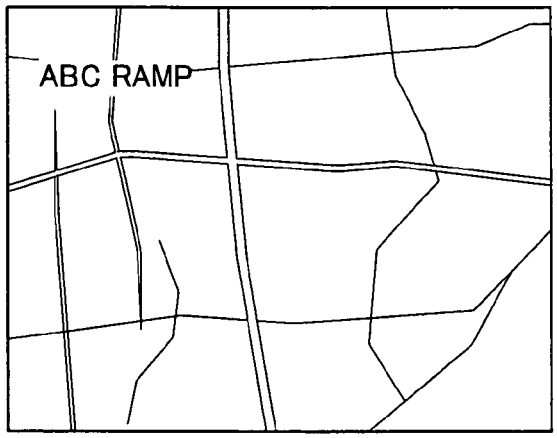
FIG. 17 is a diagram showing a bird's-eye image in the case where a sight line is directed vertically downward according to the first embodiment.
Figure 18:
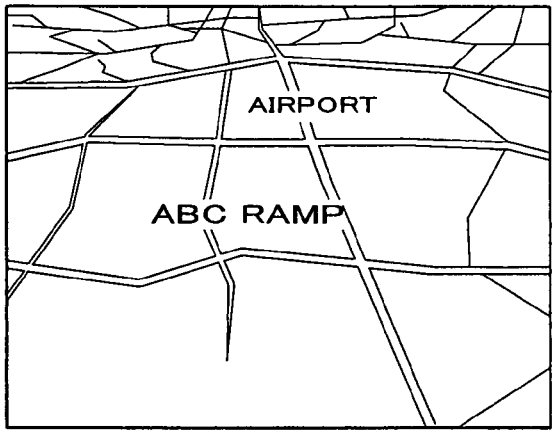
FIG. 18 is a diagram showing a bird's-eye image in the case where the sight line is directed forward according to the first embodiment.
Figure 19:
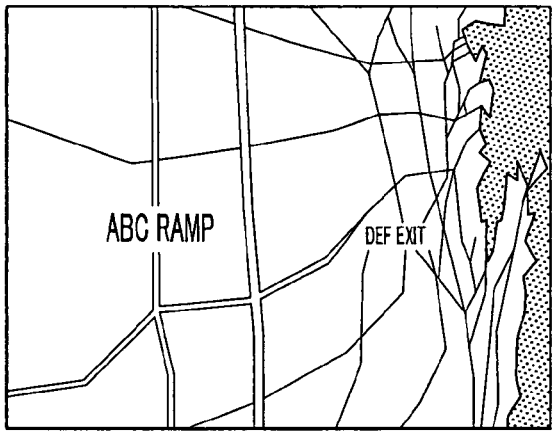
FIG. 19 is a diagram showing a bird's-eye image in the case where the sight line is directed rightward according to the first embodiment.
Figure 20:
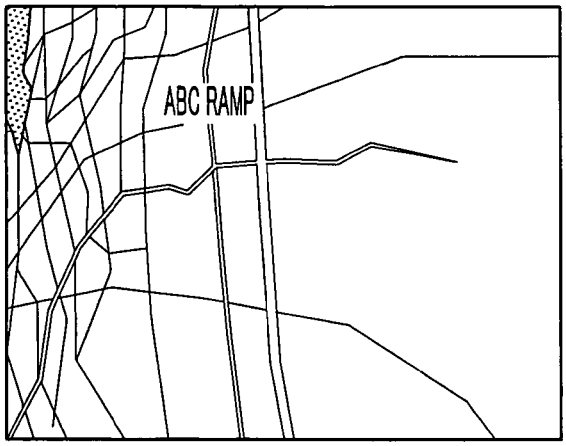
FIG. 20 is a diagram showing a bird's-eye image in the case where the sight line is directed leftward according to the first embodiment.
Figure 21:
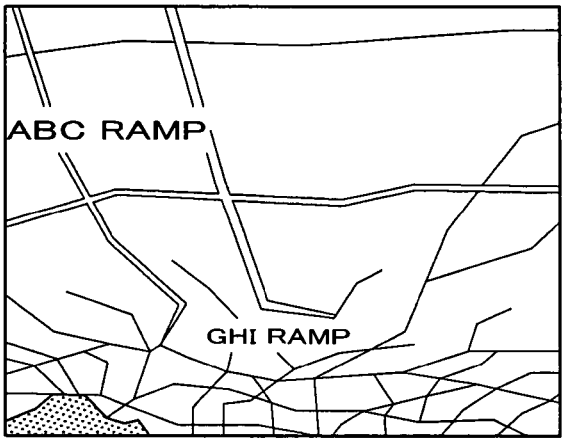
FIG. 21 is a diagram showing a bird's-eye image in the case where the sight line is directed backward according to the first embodiment.
Figure 22:
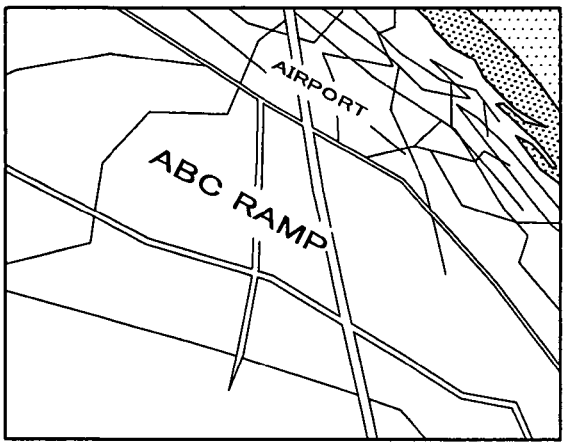
FIG. 22 is a diagram showing a bird's-eye image in the case where the sight line is directed forward on the right according to the first embodiment.
Figure 23:
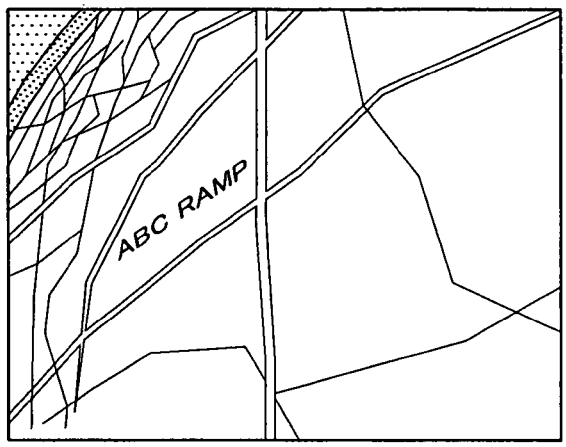
FIG. 23 is a diagram showing a bird's-eye image in the case where the sight line is directed forward on the left according to the first embodiment.
Figure 24:
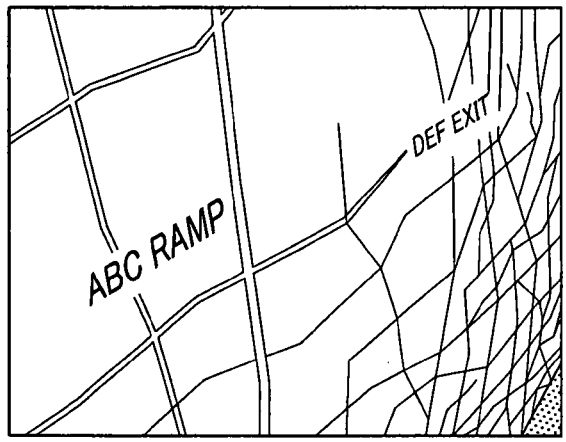
FIG. 24 is a diagram showing a bird's-eye image in the case where the sight line is directed backward on the right according to the first embodiment.
Figure 25:
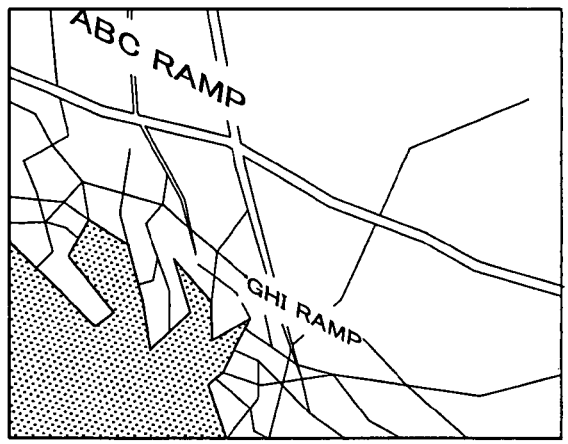
FIG. 25 is a diagram showing a bird's-eye image in the case where the sight line is directed backward on the left according to the first embodiment.
Figure 26A:
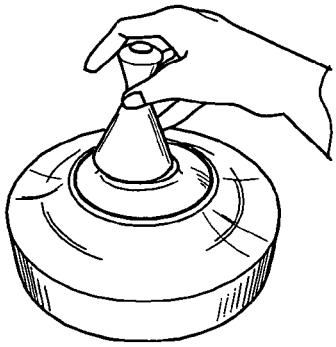
FIGS. 26A to 26H are perspective views showing examples of holding the two-hinge stick input device according to the first embodiment.
Figure 26B:
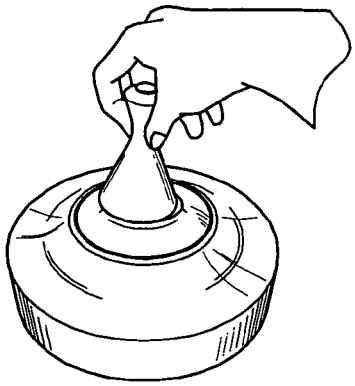
Figure 26C:
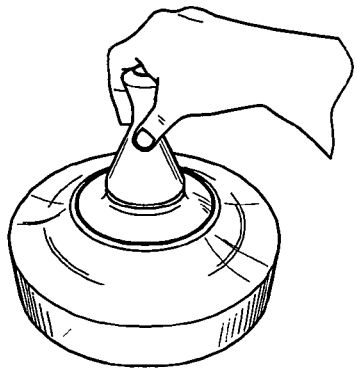
Figure 26D:
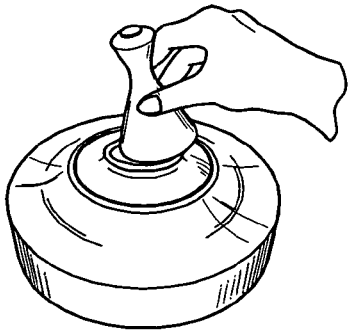
Figure 26E:
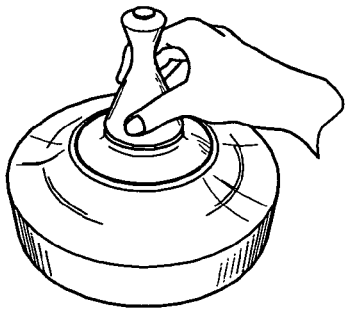
Figure 26F:
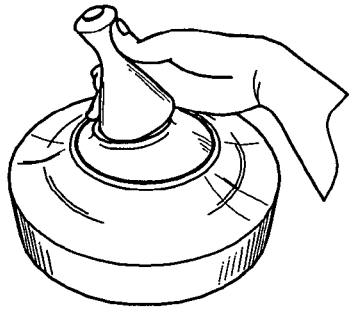
Figure 26G:
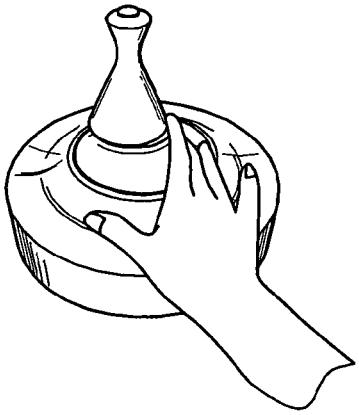
Figure 26H:
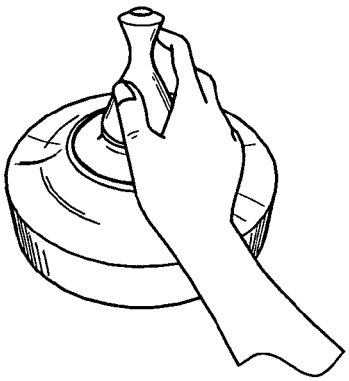

FIGS. 17 to 25 show examples of the map image displayed by the image display device 12 corresponding to the various first relative inclination bearings. FIG. 17 shows a display of the map image in the initial state. FIG. 18 shows a display of a bird's-eye map in the forward direction. FIG. 19 shows a display of the bird's-eye map in the rightward direction. FIG. 20 shows a display of the bird's-eye map in the leftward direction. FIG. 21 shows a display of the bird's-eye map in the backward direction. FIG. 22 shows a display of the bird's-eye map in the forward direction on the right. FIG. 23 shows a display of the bird's-eye map in the forward direction on the left. FIG. 24 shows a display of the bird's-eye map in the backward direction on the right. FIG. 25 shows a display of the bird's-eye map in the backward direction on the left. Thus, the maps looked down in the various directions can be displayed in addition to the map looked in the forward direction. The map display with more variety than before can be performed, so visibility of the map for the user is improved.

As described above, the vehicle navigation system 1 as an example of the image display system has the two-hinge stick input device 13*c*, the control circuit 19 and the image display device 12. If the two-hinge stick input device 13*c* receives a single-action operation of the user, the two-hinge stick input device 13*c* outputs the multiple signals based on the operation. The control circuit 19 specifies the viewpoint position, the sight line direction and the zoom value to look down the map. The image display device 12 displays the image of the map in such the manner that the map is looked down from the viewpoint position in the sight line direction specified by the control circuit 19.

Thus, when the map image is displayed in such the manner that the map is looked down from the certain viewpoint in the certain sight line direction, the viewpoint position and the sight line direction can be decided based on the single-action operation of the user. The zoom value of the displayed image can be decided based on the operation of the user applied to the two-hinge stick input device 13*c*. Accordingly, convenience of the operation of the user for adjusting the viewpoint position, the sight line direction and the zoom value is improved.

The grip 20 of the two-hinge stick input device 13*c* has the dial 21 and the narrowed portion 22*a* extending upward above the supporting point section 31*a* and has the skirt portion 22*b* extending below the supporting point section 31*a* to cover the upper portion of the moving section 30. Accordingly, the height of the space occupied by the operating device can be restricted. Thus, a variety of methods can be used as a method of gripping and operating the grip 20 to adjust the first inclination and the second inclination. FIGS. 26A to 26H show various methods of holding the grip 20 corresponding to preferences of the users or operation objects. As shown in FIGS. 26A to 26H, the protrusion 38*a* can be seen if the first inclination is changed from the first initial inclination. The user can visually confirm the present first relative inclination angle and the present first relative bearing based on the deviation of the lower end of the skirt portion 22*b* from the movable dome 38.

Next, a vehicle navigation system 1 according to a second embodiment of the present invention will be explained. The vehicle navigation system 1 according to the present embodiment is different from the vehicle navigation system 1 of the first embodiment in that the vehicle navigation system 1 according to the present embodiment has a two-hinge stick input device 13*c*' shown in FIG. 27 instead of the two-hinge stick input device 13*c* shown in FIG. 2.

Figure 27:
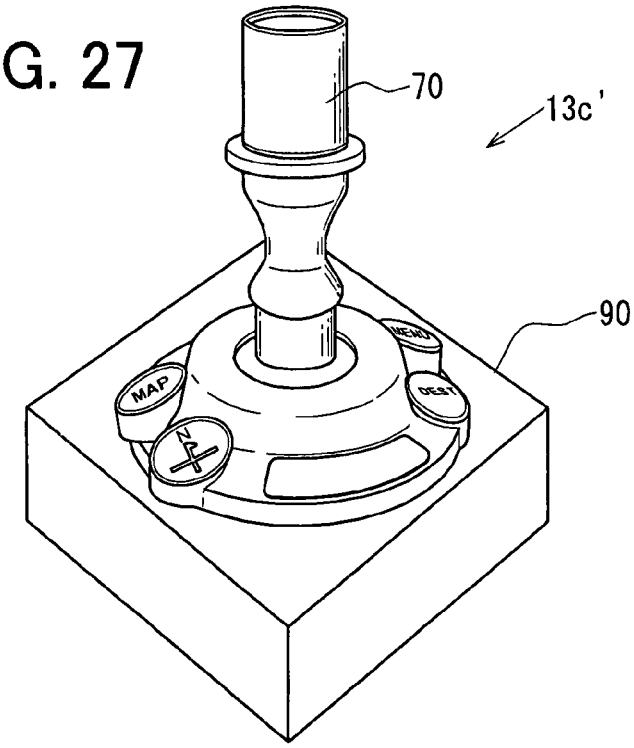
FIG. 27 is a perspective view showing a two-hinge stick input device according to a second embodiment of the present invention.
Figure 28:
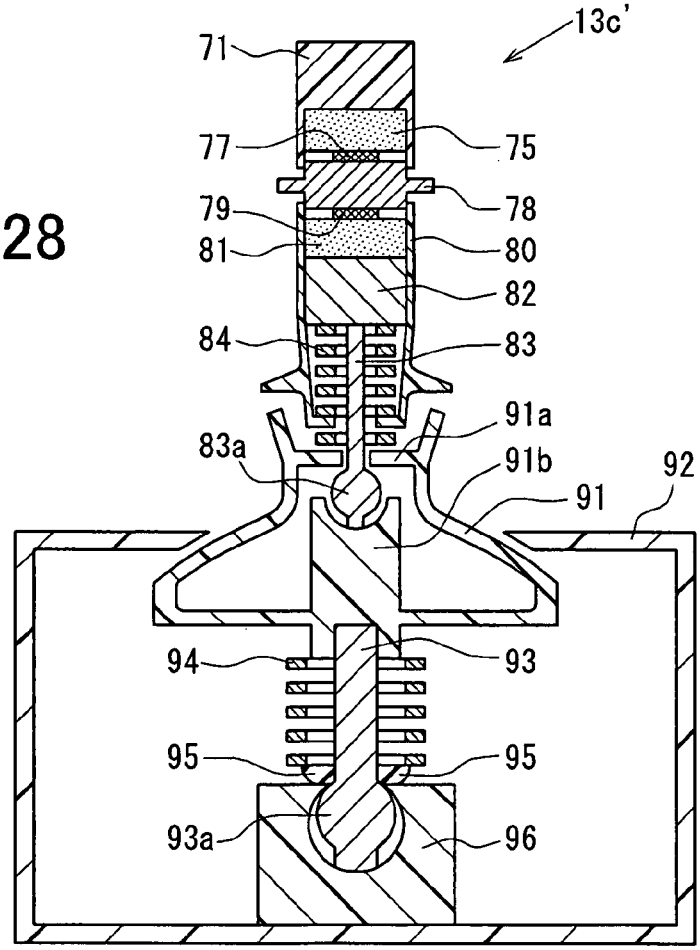
FIG. 28 is a vertical cross-sectional diagram showing the two-hinge stick input device according to the second embodiment.

The two-hinge stick input device 13*c*' has a grip 70 to be gripped and operated by the user and a base section 90 under the grip 70 as shown in FIG. 27. FIG. 28 is an elevating sectional view showing the two-hinge stick input device 13*c*'. As shown in FIG. 28, the grip 70 has an upper casing 71, a sensing section 75, a transmission section 77, an up-down switch 78, a body casing 80, a sensing section 81, a fixing section 82, a first shaft section 83, a first spring 84 and the like. The base section 90 has a grip receiving section 91, a base section casing 92, a second shaft section 93, a second spring 94, a cushion 95, a base 96 and the like.

The upper casing 71 is formed in the shape of a circular cylinder having a bottom concaved upward. The upper casing 71 provides a side face and an upper face of an upper portion of the grip 70. The sensing section 75, the transmission section 77, the up-down switch 78, the transmission section 79 and the sensing section 81 are provided under the upper casing 71 in that order from the upside. The up-down switch 78 has a disc-like main body and a flange section protruding outward further than the outer periphery of the upper casing 71. If the flange section is pushed down by the user, the main body and the transmission section 79 descend correspondingly. Thus, the sensing section 81 senses the descent through the transmission section 79 and outputs a signal indicative of the sensing to the control circuit 19. If the flange section is pushed upward by the user, the main body and the transmission section 77 ascend correspondingly. Thus, the sensing section 75 senses the ascent through the transmission section 77 and outputs a signal indicative of the sensing to the control circuit 19. The control circuit 19 can sense existence or non-existence of the pushing-up operation or the pushing-down operation of the user applied to the up-down switch 78 based on the outputted signals.

The fixing section 82 in the shape of a circular cylinder is provided immediately under the sensing section 81. The rod-like first shaft section 83 perpendicularly contacts the center of the bottom of the fixing section 82. A spherical first ball section 83*a* is formed at a lower portion of the first shaft section 83. The first spring 84 is wound around the first shaft section 83 above the first ball section 83*a*. The body casing 80 covers side surfaces of the transmission section 79, the sensing section 81, the fixing section 82, the first shaft section 83 and the first spring 84.

The grip receiving section 91 for supporting the grip 70 is provided under the grip 70. The grip receiving section 91 has a shape of a hollow disc that bulges upward and that is formed with a hole at the center of its upper face as shown in FIG. 28. The first shaft section 83 extends to an inside of the grip receiving section 91 through the hole. The first ball section 83*a* is located inside the grip receiving section 91. The grip receiving section 91 has a flat spring receiving section 91*a* around the hole. A lower end of the first spring 84 strikes against the spring receiving section 91*a*. The grip receiving section 91 has a ball receiving section 91*b* for supporting the first ball section 83*a* inside the receiving section 91.

The rod-like second shaft section 93 is fixed to the center of the bottom of the grip receiving section 91 perpendicularly to the bottom. A spherical second ball section 93*a* is provided at a lower portion of the second shaft section 93. The second spring 94 is wound around the second shaft 93 above the second ball section 93*a*. The ring-shaped cushion 95 is attached to the bottom of the second spring 94.

The base 96 for supporting the members 91-95 is provided under the second shaft section 93. The lower portion of the grip receiving section 91, the second shaft section 93, the second spring 94, the cushion 95 and the base 96 are accommodated in the base section casing 92 formed with a hole at an upper portion thereof.

Figure 29:
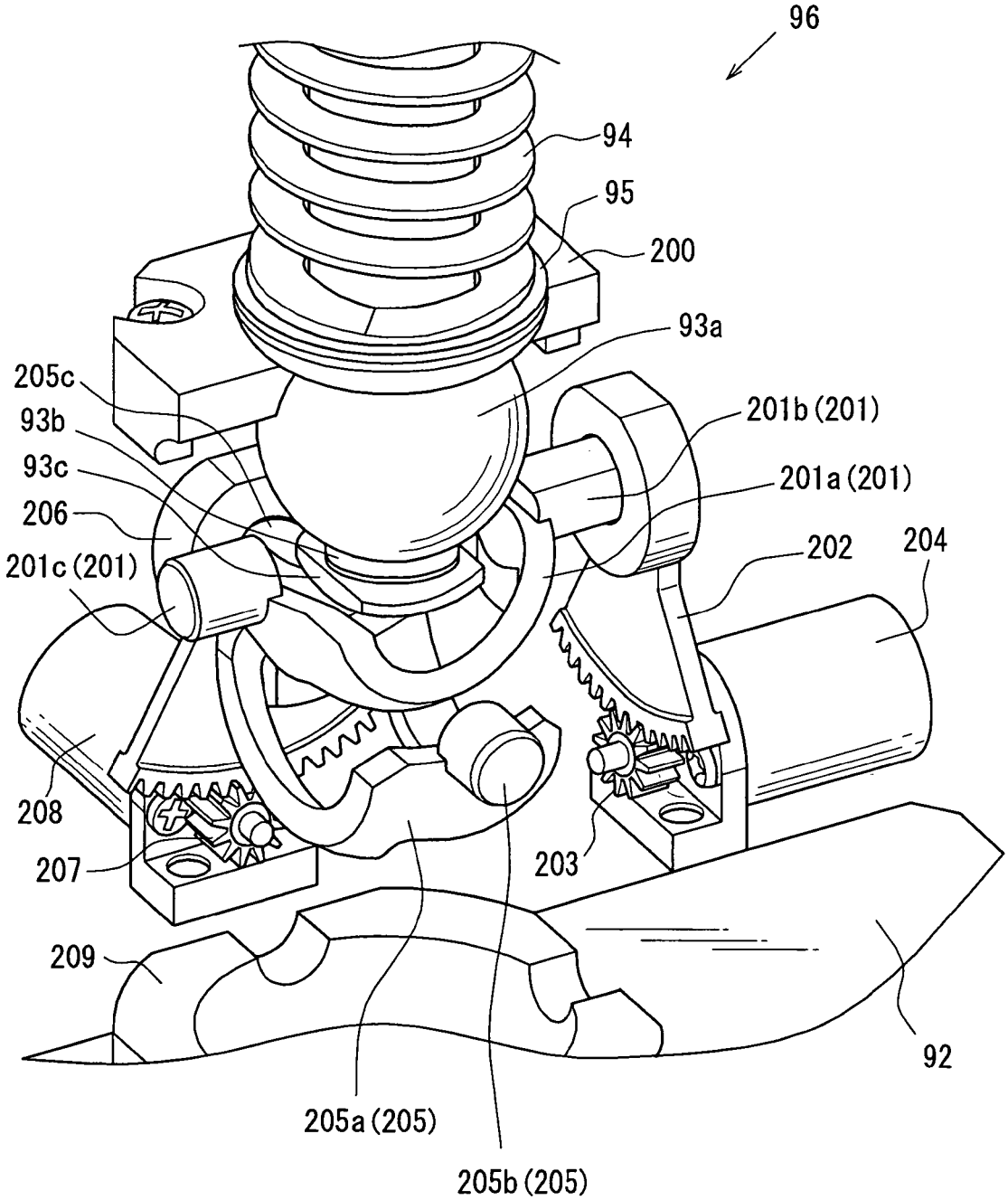
FIG. 29 is a detailed perspective view showing a ball receiving section of the two-hinge stick input device according to the second embodiment.

Next, the structure of the base 96 supporting the members 91-95 will be explained. FIG. 29 is an assembly diagram showing a detailed structure of the base 96. As shown in FIG. 29, the base 96 has a spring support 200, a first rotating section 201, a first pendulum 202, a first gear 203, a first transmission section 204, a second rotating section 205, a second pendulum 206, a second gear 207, a second transmission section 208 and a base fixing section 209. The second ball section 93*a* has a neck section 93*b* in the shape of a short circular column, which extends immediately downward from the spherical main body of the second ball section 93*a*, and a long plate section 93*c* expanding immediately under the neck section 93*b*.

The spring support 200 is fixed to the base section casing 92 through a member (not shown). Thus, the spring support 200 supports the cushion 95, the second spring 94 and the like. The first rotating section 201 has a perforated section 201*a* made of a resin and two shaft sections 201*b*, 201*c*. The perforated section 201*a* is formed in the shape of a hammock formed with a hole at the center thereof. The two shaft sections 201*b*, 201*c* are attached to the both ends of the perforated section 201*a*. The first pendulum 202 is fixed to the shaft of the shaft section 201*b*. Thus, the first pendulum 202 rotates with the shaft section 201*b*. Teeth are formed on the peripheral edge of the first pendulum 202. The first gear 203 meshes with the teeth of the first pendulum 202. Thus, the first gear 203 rotates in accordance with the rotation of the first pendulum 202. The first transmission section 204 is fixed coaxially with the first gear 203. Thus, the first transmission section 204 rotates in synchronization with the rotation of the first gear 203.

The second rotating section 205 has a perforated section 205*a* in the same shape as the first rotating section 201 and two shaft sections 205*b*, 205*c* attached to the both ends of the perforated section 205*a* coaxially with the both ends. The second pendulum 206 is fixed to the shaft of the shaft section 205*c*. Thus, the second pendulum 206 rotates with the shaft section 205*c*. Teeth are formed on the peripheral edge of the second pendulum 206. The second gear 207 meshes with teeth of the second pendulum 206. Thus, the second gear 207 rotates in accordance with the rotation of the second pendulum 206. The second transmission section 208 is fixed to the second gear 207 coaxially. Thus, the second transmission section 208 rotates in synchronization with the rotation of the second gear 207.

When the base 96 is assembled, the second rotating section 205 is located immediately below the first rotating section 201 perpendicularly to the first rotating section 201. The lower end portion of the second ball section 93*a* is fitted into the first rotating section 201 and the second rotating section 205 such that the long plate section 93*c* is located in the hole of the perforated section 205*a* and such that the neck section 93*b* is located in the hole of the perforated section 201*a*. The shaft sections 201*b*, 201*c*, 205*b*, 205*c* are fitted to grooves formed at the upper end of the cylindrical base fixing section 209 fixed to the base casing 92.

If the second shaft section 93 tilts in a certain direction in the thus-assembled base 96, the neck section 93*b* and the long plate section 93*c* move in accordance with the direction of the tilt. The first rotating section 201 and the second rotating section 205 are pushed by the neck section 93*b* and the long plate section 93*c* and rotate about the shafts thereof. Accordingly, the first pendulum 202 and the second pendulum 206 rotate in accordance with the rotation of the first rotating section 201 and the second rotating section 205. Moreover, the first gear 203 and the second gear 207 rotate. Moreover, the first transmission section 204 and the second transmission section 208 rotate. A rotary encoder (not shown) senses rotation amounts of the first transmission section 204 and the second transmission section 208 and outputs signals indicative of the sensed rotation amounts to the control circuit 19.

With this structure, the members 91-95 are supported by the base 96 such that the members 91-95 can tilt about the second ball section 93*a*, which functions as the supporting point, in the all directions of 360°. The signals indicative of the amount and the bearing of the tilt can be outputted to the control circuit 19. The first ball section 83*a* and the ball receiving section 91*b* shown in FIG. 28 have the same structures as the second ball section 93*a* and the base 96. Accordingly, the grip 70 is supported by the ball receiving section 91*b* such that the grip 70 can tilt about the ball receiving section 91*b*, which functions as the supporting point, in the all directions of 360°. The signals indicative of the amount and the bearing of the tilt can be outputted to the control circuit 19.

Thus, the two-hinge stick input device 13*c*' has the grip 70, which is gripped by the user, the members 91-95 for supporting the grip 70 at the ball receiving section 91*b*, and the base 96 for supporting the second ball section 93*a* of the members 91-95. The grip 70 can tilt about the ball receiving section 91*b* acting as the supporting point. The, members 91-95 can tilt about the second ball section 93*a* acting as the supporting point.

If the user applies a force to the two-hinge stick input device 13*c*' by gripping the grip 70, the force is transmitted to the grip 70 and to the members 91-95 from the grip 70 through the ball receiving section 91*b*. Due to the force, the grip 70 can tilt with respect to the members 91-95 about the ball receiving section 91*b* acting as the supporting point. The members 91-95 can tilt with respect to the base 96 about the second ball section 93*a* acting as the supporting point.

The user can adjust independently the moment around the ball receiving section 91*b* and the moment around the second ball section 93*a* applied to the grip 70 by applying the force pushing the grip 70 and the force twisting the grip 70 with the hand gripping the grip 70. Accordingly, the user can adjust the inclination of the grip 70 with respect to the members 91-95 (first inclination) and the inclination of the members 91-95 with respect to the base 96 (second inclination) respectively by only gripping the grip 70 and by applying the force to the grip 70 through the hand gripping the grip 70. Accordingly, multiple inputs can be performed by a single-action operation through the hand (palm, for example) of the user gripping the two-hinge stick input device 13*c*'.

If the grip 70 tilts with respect to the ball receiving section 91*b*, the force applied from the spring receiving section 91*a* to the bottom of the first spring 84 increases at a certain part of the bottom and decreases at another part of the bottom. Accordingly, the grip 70 receives a force returning the first inclination to the first initial inclination (i.e., inclination of grip 70 in initial state shown in FIG. 28). If the second shaft section 93 tilts with respect to the base 96, the force applied from the spring support 200 to the bottom of the cushion 95 increases at a certain part of the bottom and decreases at another part of the bottom. Accordingly, the second shaft section 93 receives a force returning the second inclination to the second initial inclination (i.e., inclination of second shaft 93 in initial state shown in FIG. 28).

Respective restoring forces of the first spring 84 and the second spring 94 are adjusted such that, when the user pushes a point on the grip 70, the first inclination hardly changes compared to the change in the second inclination regardless of the position of the pushed point. For example, the motion around the ball receiving section 91*b* acting as the supporting point may be hardened by setting a spring coefficient of the first spring 84 half as large again as a spring coefficient of the second spring 94. Accordingly, the user can adjust only the second inclination by pushing or pulling the grip 70 naturally and straight with the hand gripping the grip 70 through the elbow and shoulder when the user wants to adjust only the second inclination. Thus, a twisting force necessary for mainly adjusting the second inclination is small, so the adjustment of the second inclination is facilitated.

The control circuit 19 according to the present embodiment obtains the angle information at Step S110 based on the signals indicative of the amount and the bearing of the second inclination out of the signals outputted from the two-hinge stick input device 13*c*' during the execution of the program 100. The control circuit 19 obtains the scroll information at Step S120 based on the signals indicative of the amount and the bearing of the first inclination. The control circuit 19 obtains the zoom information at Step S130 based on the signals from the sensing section 75 and the sensing section 81.

Figure 30:
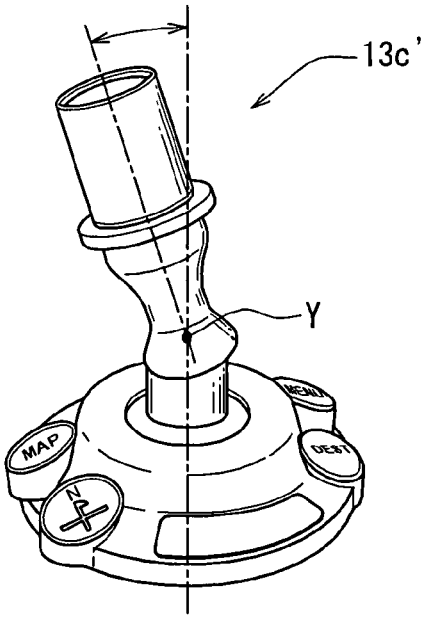
FIG. 30 is a perspective view showing an operation example of the two-hinge stick input device according to the second embodiment.
Figure 31:
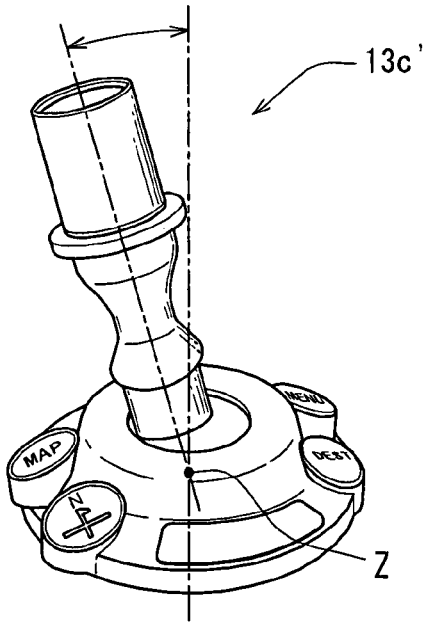
FIG. 31 is a perspective view showing another operation example of the two-hinge stick input device according to the second embodiment.
Figure 32:
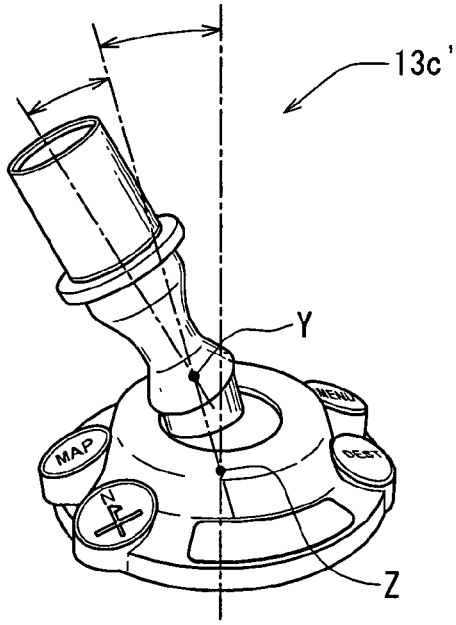
FIG. 32 is a perspective view showing yet another operation example of the two-hinge stick input device according to the second embodiment.

Accordingly, with the system according to the present embodiment, the viewpoint can be moved, i.e., the map image on the image display device 12 can be scrolled, by tilting the grip 70 about the hinge Y corresponding to the ball receiving section 91*b* with respect to the members 91-95 as shown in FIG. 30. As shown in FIG. 31, the sight line direction, i.e., the direction and the inclination of the map image on the image display device 12, can be adjusted by tilting the members 91-95 about the hinge Z corresponding to the second ball section 93*a* with respect to the base 96. As shown in FIG. 32, the scroll and the sight line direction can be simultaneously adjusted by tilting the grip 70 about the hinge Y and by tilting the members 91-95 about the hinge Z. At that time, by keeping pushing up (or down) the up-down button 78, the contraction scale of the map displayed by the image display device 12 is increased (or decreased).

The above-described embodiments may be modified.

For example, the dial 21, the narrowed portion 22*a* and the upper portions (for example, button 23) may not be provided in the first embodiment. That is, the skit section 22*b* alone can function as the grip 20.

The device applied with the present invention is not limited to the vehicle navigation system. The present invention can be applied to any device as long as the device displays an image.

The two-hinge stick input device 13*c* (13*c*') may be structured such that the first inclination hardly changes compared to the second inclination when the user pushes a specified part of the grip 20 (70).

While the invention has been described in connection with what is presently considered to be the most practical and preferred embodiments, it is to be understood that the invention is not to be limited to the disclosed embodiments, but on the contrary, is intended to cover various modifications and equivalent arrangements included within the spirit and scope of the appended claims.

What is claimed is:

1. An operating device comprising:

a grip;

a first supporting section that has a first end and a second end and that supports the grip with the first end;

a second supporting section for supporting the second end of the first supporting section;

a first resisting section for exerting a force in a direction for returning a first inclination of the grip with respect to the first supporting section to a first initial inclination; and a second resisting section for exerting a force in a direction for returning a second inclination of the first supporting section with respect to the second supporting section to a second initial inclination, wherein the grip can tilt about the first end of the first supporting section such that the first end acts as a supporting point, the first supporting section can tilt about the second end such that the second end acts as a supporting point, and the operating device is adjusted such that the first resisting section and the second resisting section exert the forces that provide a larger difference between the second inclination and the second initial inclination than a difference between the first inclination and the first initial inclination when only a point on the grip is pushed.

2. An operating device comprising:

a grip;

a first supporting section that has a first end and a second end and that supports the grip with the first end;

a second supporting section for supporting the second end of the first supporting section;

a first resisting section for exerting a force in a direction for returning a first inclination of the grip with respect to the first supporting section to a first initial inclination; and a second resisting device for exerting a force in a direction for returning a second inclination of the first supporting section with respect to the second supporting section to a second initial inclination, wherein the grip can tilt about the first end of the first supporting section such that the first end acts as a supporting point, the first supporting section can tilt about the second end such that the second end acts as a supporting point, and the operating device is structured such that a direction of the first initial inclination is different from a direction of the second initial inclination.

3. The operating device as in claim 2, wherein the operating device is structured such that an angular difference between the direction of the first initial inclination and the direction of the second initial inclination is equal to or greater than 90 degrees.

4. An operating device comprising:

a grip;

a first supporting section that has a first end and a second end and that supports the grip with the first end; and a second supporting section for supporting the second end of the first supporting section, wherein the grip can tilt about the first end of the first supporting section such that the first end acts as a supporting point, the first supporting section can tilt about the second end such that the second end acts as a supporting point, and the grip extends in a direction from the first end toward the second end of the first supporting section to cover the first supporting section, the grip has a grip end on a side of the second end, the grip end is in a shape of a disc that surrounds the first supporting section, and the grip can tilt with respect to the first supporting section in all directions of 360 degrees.

5. The operating device as in claim 4, wherein the grip has a skirt portion in a shape of a skirt that surrounds the first end of the first supporting section and expands toward the second end of the first supporting section, an inner periphery of the skirt portion near the second end of the first supporting section meshes with an outer edge portion of the grip end, the grip end is made of an elastic member, and a center of the grip end is cut out to surround the first supporting section.

6. An operating device comprising:

a grip;

a first supporting section that has a first end and a second end and that supports the grip with the first end; and a second supporting section for supporting the second end of the first supporting section, wherein the grip can tilt about the first end of the first supporting section such that the first end acts as a supporting point, the first supporting section can tilt about the second end such that the second end acts as a supporting point, the first supporting section includes a plurality of rods contacting different positions on the grip, the first supporting section further includes a deviation sensing section for sensing the inclination of the grip with respect to the first supporting section in all directions of 360 degrees by sensing a positional deviation among the rods caused by a change in the inclination of the grip, and the grip accommodates the rods.

7. The operating device as in claim 6, wherein the rods are respectively fitted to engage portions of the deviation sensing section to transmit the positional deviation among the rods to the deviation sensing section.

8. The operating device as in claim 7, wherein the rods include four rods contacting the grip when the grip is not inclined with respect to the first supporting section.

9. An operating device comprising:

a grip; and a supporting section that has an end supporting the grip, wherein the grip can tilt about the end of the supporting section such that the end acts as a supporting point, the supporting section includes a plurality of rods contacting different positions on the grip, the supporting section further includes a deviation sensing section for sensing the inclination of the grip with respect to the supporting section in all directions of 360 degrees by sensing a positional deviation among the rods caused by a change in the inclination of the grip, and the grip accommodates the rods.

10. The operating device as in claim 9, wherein the grip can be gripped by a user of the operating device.

11. The operating device as in claim 9, wherein the rods are respectively fitted to engage portions of the deviation sensing section to transmit the positional deviation among the rods to the deviation sensing section.

12. The operating device as in claim 11, wherein the rods include four rods contacting the grip when the grip is not inclined with respect to the supporting section.

13. An operating device comprising:

a grip; and a supporting section for supporting an end of the grip, wherein the grip can tilt about the end thereof such that the end acts as a supporting point, the supporting section has a spherical rotating member that contacts and supports the end of the grip, the end of the grip is formed with a curved face providing a concave shape facing the rotating member, the end of the grip is supported by the rotating member at a part of the curved face, the curved face has a curvature radius longer than a radius of the rotating member, and a contact portion of the curved face, at which the curved face is in contact with the rotating member, changes when the grip is inclined with respect to the supporting section.

14. The operating device as in claim 13, wherein the grip can be gripped by a user of the operating device.

15. The operating device according to claim 13, further comprising:

a sensing section for sensing both a direction of rotation and an amount of rotation based on a single operation of the rotating member.

* * * * *